US005232822A

United States Patent [19]

Ishikawa et al.

[11] Patent Number: 5,232,822

[45] Date of Patent: Aug. 3, 1993

[54] METHOD FOR PROCESSING LIGHT-SENSITIVE SILVER HALIDE COLOR PHOTOGRAPHIC MATERIAL

[75] Inventors: Masao Ishikawa; Shigeharu Koboshi, both of Hino, Japan

[73] Assignee: Konica Corporation, Tokyo, Japan

[21] Appl. No.: 733,952

[22] Filed: Jul. 17, 1991

Related U.S. Application Data

[63] Continuation of Ser. No. 419,884, Oct. 11, 1989, abandoned.

[30] Foreign Application Priority Data

Oct. 15, 1988 [JP] Japan ..... 63-259854

[51] Int. Cl.[5] ..... G03C 7/42

[52] U.S. Cl. ..... 430/393; 430/430; 430/455; 430/460; 430/461

[58] Field of Search ..... 430/393, 400, 430, 455, 430/460, 461

[56] References Cited

U.S. PATENT DOCUMENTS

| | | | |
|---|---|---|---|
| 4,601,975 | 7/1986 | Koboshi et al. | 430/430 |
| 4,621,047 | 11/1986 | Kishimoto et al. | 430/430 |
| 4,745,048 | 5/1988 | Kishimoto et al. | 430/393 |
| 4,804,618 | 2/1989 | Ueda et al. | 430/393 |
| 4,818,664 | 4/1989 | Ueda et al. | 430/430 |
| 4,822,725 | 4/1989 | Abe et al. | 430/393 |
| 4,845,017 | 7/1989 | Kishimoto et al. | 430/393 |
| 4,914,009 | 4/1990 | Ueda et al. | 430/393 |
| 4,933,266 | 6/1990 | Stephen et al. | 430/430 |
| 4,985,347 | 1/1991 | Fujimoto et al. | 430/430 |

FOREIGN PATENT DOCUMENTS

| | | | |
|---|---|---|---|
| 293729 | 11/1988 | European Pat. Off. | 430/430 |
| 329088 | 8/1989 | European Pat. Off. | 430/430 |
| 097953 | 4/1988 | Japan | 430/430 |
| 250651 | 10/1988 | Japan | 430/430 |

OTHER PUBLICATIONS

James, T. H., The Theory of the Photographic Process, pp. 450–453 and 462–464, 1977.

*Primary Examiner*—Hoa Van Le

*Attorney, Agent, or Firm*—Frishauf, Holtz, Goodman & Woodward

[57] ABSTRACT

A method for processing a light-sensitive silver halide color photographic material including color developing processing, and fixing. The bleaching is with a bleaching solution containing at least one of ferric complexes of the compounds represented by the formula (A) or (b) shown below and has a pH of 2.0 to 5.5. The fixing is with a processing solution having fixing ability and which contains at least one mole/liter of a thiosulfate. Said processing solution having fixing ability contains a compound selected from the group (FB).

Formula (A)

wherein $A_1$ to $A_4$ may be either the same or different, and each represent $-CH_2OH$, $-COOM$ or $-PO_3M_1M_2$; M, $M_1$ and $M_2$ each represent hydrogen atom, sodium atom, potassium atom or ammonium group; X represents a substituted or unsubstituted alkylene group having 3 to 6 carbon atoms, Formula (B)

wherein $A_1$ to $A_4$ may be either the same or different and each represent $-CH_2OH$, $-COOM$ or $-PO_3M_1M_2$; M, $M_1$ and $M_2$ each represent hydrogen atom, sodium atom, potassium atom or ammonium group; n represents an integer of 1 to 8; $B_1$ and $B_2$ each represent a substituted or unsubstituted alkylene group having 2 to 5 carbon atoms, which may be either the same or different, and (FB) is thiourea, ammonium iodide, potassium iodide, ammonium thiocyanate, potassium thiocyanate, sodium thiocyanate or thiocyanocatechol.

5 Claims, No Drawings

METHOD FOR PROCESSING LIGHT-SENSITIVE SILVER HALIDE COLOR PHOTOGRAPHIC MATERIAL

This application is a continuation of application Ser. No. 07/419,884, filed Oct. 11, 1989 (abandoned).

BACKGROUND OF THE INVENTION

This invention relates to a method for processing a light-sensitive silver halide color photographic material, more particularly to a method for processing a light-sensitive silver halide color photographic material which is capable of performing processing rapidly and improved in bleaching fog and also improved in fixability.

Processing of light-sensitive material comprises basically two steps of color developing and desilverization, and desilverization comprises the steps of bleaching and fixing or the bleach-fixing step. In addition to the above steps, the rinsing step, the stabilizing step, etc. are added as additional steps.

For the processing solution having bleaching ability to be used in the desilverization step of light-sensitive material, as the oxidizing agent for bleaching the image silver, inorganic oxidizing agents such as potassium ferricyanide, dichromic acid salt, etc. have been widely used.

However, for the processing solution having bleaching ability containing these inorganic oxidizing agents, some vital defects have been pointed out. For example, although potassium ferricyanide and dichromic acid salt are relatively excellent in bleaching power of image silver, there is fear that they may be decomposed by light to generate cyan ions or hexavalent chromium ions harmful to human bodies, thus having undesirable properties in view of prevention of pollution. Further, the processing solution containing these inorganic oxidizing agents have the drawback that it is difficult to regenerate these agents for use without discarding the waste liquor after processing.

In contrast, as one suited for such requirements such as rapid processing, simplification and regeneration availability of waste liquor, etc. without little problem in pollution, processing liquors with the use of a metal complex of an organic acid such as aminopolycarboxylic acid metal complex, etc. as the oxidizing agent are now becoming to be used. However, the processing solution by use of a metal complex of an organic acid is slow in oxidizing power, and therefore has the drawback that the bleaching speed (oxidation speed) of the image silver (metallic silver) formed during the developing step is slow. For example, iron (III) ethylenediaminetetra acetic acid which is considered to have strong bleaching power among aminoplycarboxcylic acid metal complexes has been partially applied practically as the bleaching solution and bleach-fixing solution, but it is deficient in bleaching power in a high sensitivity light-sensitive silver halide color photographic material comprising primarily silver bromide or silver iodobromide emulsion, particularly in color paper for photographing and color negative film, color reversal film for photographing, which contains silver iodide as silver halide and has a high silver content, and therefore has a drawback that a long time is required for the bleaching step.

On the other hand, in the developing processing method, wherein a large amount of light-sensitive silver halide photographic materials are continuously processed by means of an automatic developing machine, etc., for avoiding worsening of performance of the bleaching solution due to change in concentrations of components, a means for maintaining the components of the processing solution at constant levels is required. As such means, in recent years, from the standpoints in economy and pollution, there have been proposed the so-called concentrated low replenishing system which replenish a small amount of these replenishing solutions concentrated, or alternatively the method in which a regenerant agent is added to the overflowed solution, which is then used again as the replenishing solution.

Particularly, in the bleaching solution, there has been practically applied the method in which an organic acid ferrous complex, for example, iron (II) complex of ethylenediaminetetraacetic acid is returned by aeration to iron (III) complex of ethylenediaminetetraacetic acid, namely oxidized to organic acid ferric complex, and further a regenerant is added to replenish deficient components to be used again as the replenishing solution.

However, in recent years, for short time processing of light-sensitive silver halide photographic materials, and reduction in collection and delivery cost, the so called compact laboratory (also called mini-laboratory) is coming to the forefront, and in such laboratory, simplification of processing and reduction in installation area of developing machine are highly demanded, and therefore regeneration processing requiring cumbersome labors and management, and also processing space is not desirable.

Accordingly, the concentrated low replenishing system which performs low replenishment without performing regeneration processing is preferred. However, if the amount of the bleaching solution replenished is extremely reduced, the concentration of the color developer carried over into the bleaching solution will be elevated, and also is susceptible to concentration by evaporation, whereby accumulation of the color developer components is further increased. Thus, if the concentrations of the color developer components are increased, the ratio of the color developing agent, the sulfite, etc., which are reducing components, attached and mixed into the light-sensitive material will be enhanced to inhibit the bleaching reaction, whereby there occur problems of silver retention and the so-called leuco dye formation of cyan dye. Further, as a serious problem, there occurs liability to generation of bleaching fog.

This bleaching fog is particularly stressed in low replenishment of the bleaching solution in recent years.

In recent years, the techniques employing propylenediaminetetraacetic acid ferric complex as a novel bleaching agent have been known in Japanese Unexamined Patent Publications Nos. 65441/1988, 141056/1988 and 139348/1988. However, propylenediaminetetraacetic acid ferric complex, although extremely excellent in silver bleaching ability, has been found to have several drawbacks. One is that the ferrous complex formed by the bleaching reaction of silver and the reducing components carried over with the light-sensitive material, etc. as described above can be oxidized with difficulty. For this reason, the ferrous complex formed may be accumulate in the bleaching solution to make leuco formation of the dye or generate silver retention. Also, another defect is that due to its strong oxidizing power, the color developing agent is oxidized therewith during the bleaching step, whereby indiscriminate coupling reactions may occur, thereby giving rise to the so-called bleaching fog. Further, it has been also found that, as the light-sensitive color photographic material is processed, fixability tends to deteriorate to great extent as compared with the case when ethylenediaminetetraacetic acid ferric complex of the prior art is used as the bleaching agent, which tendency will appear remarkably particularly when the amount of processing is small.

SUMMARY OF THE INVENTION

Accordingly, a first object of the present invention is to provide a method for processing a light-sensitive silver halide color photographic material which is rapid and also improved in bleaching fog and fixability. Further, a second object is to provide a method for processing a light-sensitive silver halide color photographic material which is excellent in processing stability even in the case of continuous processing and small amount processing.

The above objects of the present invention were found to be accomplished by the present inventors by a method for processing a light-sensitive silver halide color photographic by subjecting a light-sensitive silver halide color photographic material after imagewise exposure to color developing processing, then immediately to bleaching processing with a bleaching solution, followed by processing with a processing solution having fixing ability, wherein said bleaching solution contains at least one of ferric complexes of the compounds represented by the formula [A] or [B] shown below and has a pH of 2.0 to 5.5, and said processing solution having fixing ability contains at least one mole/liter of a thiosulfate:

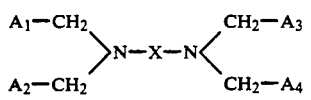

Formula [A]

wherein $A_1$ to $A_4$ may be either the same or different, and each represent $-CH_2OH$, $-COOM$ or $-PO_3M_1M_2$; M, $M_1$ and $M_2$ each represent hydrogen atom, sodium atom, potassium atom or ammonium group; X represents a substituted or unsubstituted alkylene group having 3 to 6 carbon atoms,

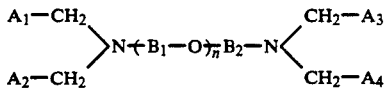

Formula [B]

wherein $A_1$ to $A_4$ may be either the same or different and each represent $-CH_2OH$, $-COOM$ or $-PO_3M_1M_2$; M, $M_1$ and $M_2$ each represent hydrogen atom, sodium atom, potassium atom or ammonium group; n represents an integer of 1 to 8; $B_1$ and $B_2$ each represent a substituted or unsubstituted alkylene group having 2 to 5 carbon atoms, which may be either the same or different.

DESCRIPTION OF PREFERRED EMBODIMENTS

Further, as another embodiment for accomplishing the objects of the present invention, there may be mentioned the method for processing a light-sensitive silver halide color photographic material as defined above, wherein said light-sensitive silver halide color photographic material has a silver halide containing 0.5 mole % or more of silver iodide in at least one layer.

As still further preferred embodiments, there may be mentioned the following six embodiments in which (1) said ferric complex of a compound represented by the formula [A] or [B] is contained in an amount of 0.1 mole or more per 1 liter of the processing solution having fixing ability, (2) said processing solution having fixing ability is a fixing solution, (3) said ferric complex contained in said bleaching solution is a compound represented by the formula [A], (4) compulsory solution stirring is imparted on at least one of said bleaching solution and said processing solution having fixing ability, (5) acetic acid is contained as a pH buffer in an amount of 0.1 to 3 moles/liter in said bleaching solution, and (6) said silver halide light sensitive color photographic material has silver halide containing silver iodide in an amount of 0.5 mole % or more in at least one layer.

First, the compounds represented by the formula [A] are to be described in detail.

$A_1$ to $A_4$ may be either the same or different and each represent $-CH_2OH$, $-COOM$ or $-PO_3M_1M_2$; M, $M_1$ and $M_2$ each represent hydrogen atom, sodium atom, potassium atom or ammonium group. X represents a substituted or unsubstituted alkylene group having 3 to 6 carbon atoms (e.g. trimethylene, tetramethylene, pentamethylene).

As the substituent, lower alkyl groups having 1 to 3 carbon atoms may be included.

In the following, preferable specific examples of the compounds represented by the above formula [A] are shown.

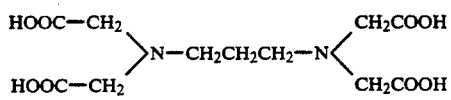

(A-1)

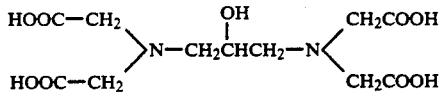

(A-2)

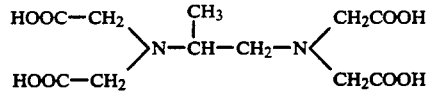

(A-3)

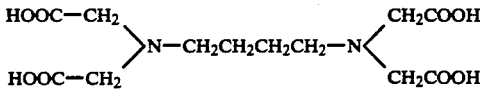

(A-4)

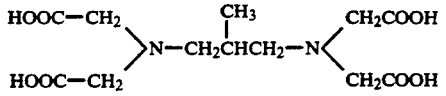

(A-5)

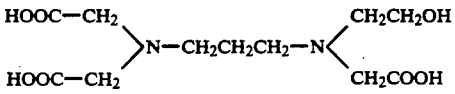

(A-6)

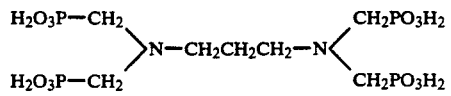

(A-7)

-continued

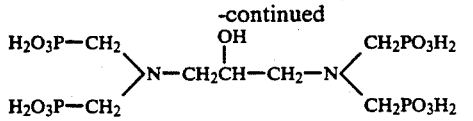
(A-8)

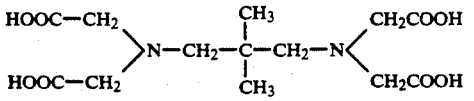
(A-9)

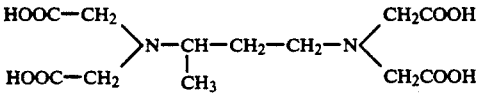
(A-10)

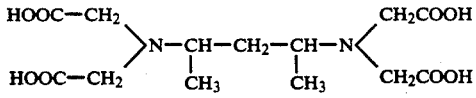
(A-11)

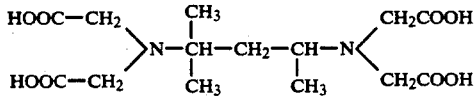
(A-12)

Other than these compounds (A-1)-(A-12), sodium salts, potassium salts or ammonium salts thereof can be also similarly preferably used.

From the standpoints of the effect of the object of the present invention and solubility, ammonium salts of these ferric complexes may be preferably used, and particularly preferably used when the ammonium salt is contained in an amount of 90% or more.

Of the above compounds, those particularly preferably used in the present invention may be (A-1), (A-4) and (A-7) and (A-9), above all (A-1) and (A-9).

Next, the compounds represented by the formula [B] are to be described in detail.

$A_1$ to $A_4$ have the same meanings as to $A_1$ to $A_4$ of the above formula [A], and n represents an integer of 1 to 8. $B_1$ and $B_2$ may be either the same or different, and each represent a substituted or unsubstituted alkylene group having 2 to 5 carbon atoms (e.g. ethylene, trimethylene, tetramethylene, pentamethylene).

As the substituent, hydroxyl group, lower alkyl groups having 1 to 3 carbon atoms (methyl, ethyl, propyl) may be included.

In the following, preferable specific examples of the compounds represented by the above formula [B] are shown.

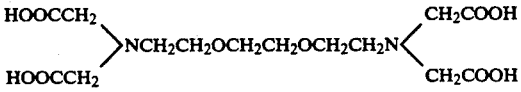
(B-1)

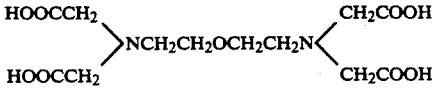
(B-2)

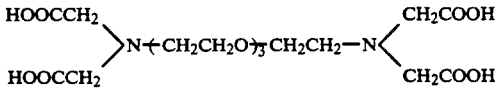
(B-3)

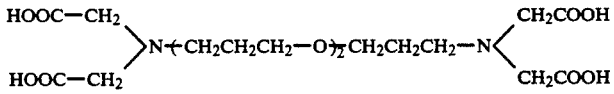
(B-4)

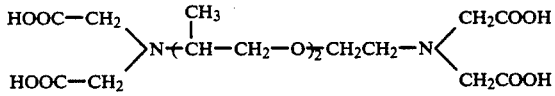
(B-5)

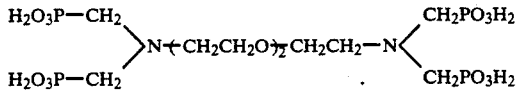
(B-6)

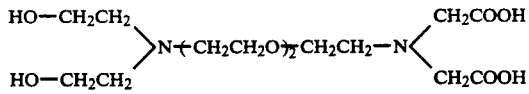
(B-7)

Other than these compounds (B-1)-(B-7), sodium salts, potassium salts or ammonium salts thereof can be also similarly preferably used.

From the standpoints of the objective effect of the present invention and solubility, ammonium salts of these ferric complexes may be preferably used, and particularly preferably be used when the ammonium salt is contained in an amount of 90% or more.

Of the above compounds, those particularly preferably used in the present invention may be (B-1), (B-4) and (B-7), above all (B-1).

The ferric complexes of the compounds represented by the formulae [A] or [B] should be preferably used in an amount of at least 0.1 mole per one liter of the bleaching solution from the standpoint of its silver bleachability, more preferably within the range of 0.15 to 0.60 mole/liter, most preferably within the range of 0.2 to 0.5 mole/liter.

In the bleaching solution of the present invention, together with the ferric complex of the compound represented by the above formula [A] or [B], other ferric aminopolycarboxylic acid complexes (e.g. ferric ethylenediaminetetraacetic acid complex, ferric diethylenetriaminepentaacetic acid complex, ferric 1,2-cyclohexanediaminetetraacetic acid complex) can be used in combination.

However, for exhibiting better the effects of the present invention, a bleaching solution using substantially only the ferric complex of the compound represented by the above formula [A] or [B] is preferred. Particularly preferably, a bleaching solution using only the ferric complex of the compound represented by the formula [A] may be used. Here, "substantially" means at least 70% (calculated on moles) of the total ferric complexes. Said ratio may be preferably 80% or more, more preferably 90% or more, most preferably 95% or more.

In the bleaching solution according to the present invention, at least one of an imidazole and its derivative and the compounds represented by the formulae [I] to [IX] shown below can be more preferably used in the present invention, because the objective effect of the present invention can be better exhibited, and further have another effect of improving the precipitation caused by the silver in the bleaching solution can also be exhibited when at least one of the above compounds are contained:

Formula [I]

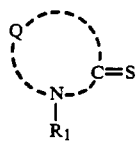

In the formula [I], Q represents a group of atoms necessary for forming a nitrogen-containing heterocycle (including those fused with 5- to 6-membered unsaturated ring), $R_1$ represents hydrogen atom, an alkyl group having 1 to 6 carbon atoms, a cycloalkyl group, an aryl group, a heterocyclic group (including those fused with 5- to 6-membered unsaturated ring) or amino group).

Formula [II]

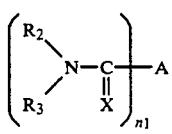

In the formula [II], $R_2$ and $R_3$ each represent hydrogen atom, an alkyl group having 1 to 6 carbon atoms, hydroxyl group, carboxyl group, amino group, an acyl group having 1 to 3 carbon atoms, an aryl group or an alkenyl group.

A represents

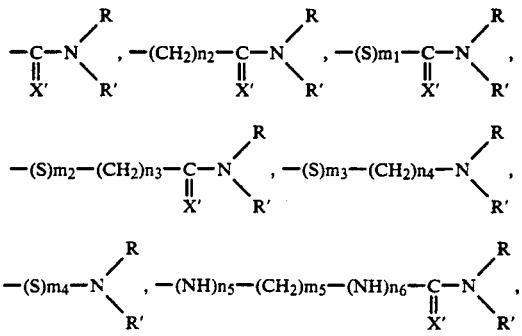

-continued

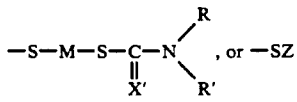

or a heterocyclic residue with $n_1$ valence (including those fused with 5- to 6-membered unsaturated ring), and X represents =S, =O or =NR". Here, R and R' are respectively the same as $R_2$ and $R_3$, X' the same as X, Z represents hydrogen atom, an alkali metal atom, ammonium group, amino group, a nitrogen-containing heterocyclic residue, an alkyl group, or

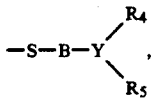

M represents a divalent metal atom, R" represents hydrogen atom, an alkyl group having 1 to 6 carbon atoms, a cycloalkyl group, an aryl group, a heterocyclic residue (including those fused with 5-to 6-membered unsaturated ring) or amino group, and $n_1$–$n_6$ and $m_1$–$m_5$ each represent an integer of 1 to 6.

B represents an alkylene group having 1 to 6 carbon atoms, Y represents

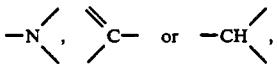

$R_4$ and $R_5$ are respectively the same as $R_2$ and $R_3$. However, $R_4$ and $R_5$ may each represent —B—SZ, and $R_2$ and $R_3$, R and R', $R_4$ and $R_5$ may be also each bonded to form a ring.

The compounds represented by said formula are also inclusive of enolized derivatives and salts thereof.

Formula [III]

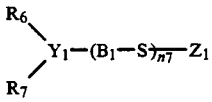

In the formula [III], $R_6$ and $R_7$ each represent hydrogen atom, an alkyl group having 1 to 6 carbon atoms, hydroxyl group, carboxyl group, amino group, an acyl group having 1 to 3 carbon atoms, an aryl group, an alkenyl group or $—B_1—S—Z_1$. However, $R_6$ and $R_7$ may be also bonded to form a ring. $Y_1$ represents

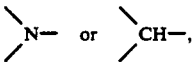

$B_1$ represents an alkylene group having 1 to 6 carbon atoms, $Z_1$ represents hydrogen atom, an alkali metal atom, ammonium group, an hydrogen atom, an alkali metal atom, ammonium group, an amino group, a nitrogen-containing heterocyclic residue or

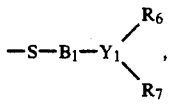

and $n_7$ represents an integer of 1 to 6.

Formula [IV]

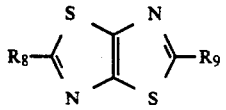

In the formula [IV], $R_8$ and $R_9$ each represent:

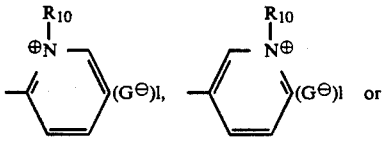

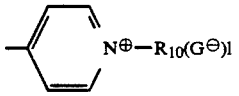

and $R_{10}$ represents an alkyl group or $-(CH_2)_{n8}SO_3^{\ominus}$ (with proviso that when $R_{10}$ is $-(CH_2)_{n8}SO_3^{\ominus}$, l represents 0 and when it is an alkyl, l represents 1).

$G^{\ominus}$represents an anion. $n_8$ represents an integer of 1 to 6.

Formula [V]

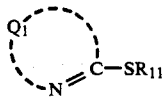

In the formula [V], $Q_1$ represents a group of atoms necessary for forming a nitrogen-containing heterocycle (including those fused with 5- to 6-membered unsaturated or saturated ring), $R_{11}$ represents hydrogen atom, an alkali metal atom,

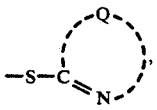

or an alkyl group. However, Q' has the same meaning as $Q_1$.

Formula [VI]

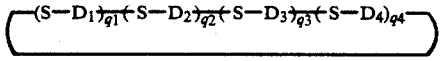

In the formula [VI], $D_1$, $D_2$, $D_3$ and $D_4$ are each mere bonding arm, an alkylene having 1 to 8 carbon atoms or vinylene group, $q_1$, $q_2$, $q_3$ and $q_4$ each represent 0, 1 or 2.

Also, the ring formed together with sulfur atom may be further fused with a 5- to 6-membered saturated or unsaturated ring.

Formula [VII]

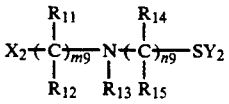

In the formula [VII], X2 represents —COOM', —OH, $-SO_3M'$, $-CONH_2$, $-SO_2NH_2$, $-NH_2$, —SH, —CN, $-CO_2R_{16}$, $-OR_{16}$, $-NR_{16}R_{17}$, $-SR_{16}$, $-SO_3R_{16}$, $-NHCOR_{16}$, $-NHSO_2R_{16}$, $-OCOR_{16}$ or $-SO_2R_{16}$, $Y_2$ represents

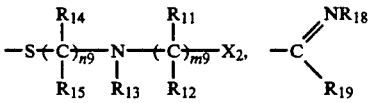

or hydrogen atom, $m_9$ and $n_9$ each represent an integer of 1 to 10. $R_{11}$, $R_{12}$, $R_{13}$, $R_{14}$, $R_{15}$, $R_{17}$ and $R_{18}$ each represent hydrogen atom, a lower alkyl group, an acyl group or

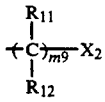

$R_{16}$ represents an alkyl group, $R_{19}$ represents $-NR_{20}R_{21}$, $-OR_{22}$ or $-SR_{22}$, $R_{20}$ and $R_{21}$ each represent hydrogen atom or a lower alkyl group, $R_{22}$ represents a group of atoms necessary for forming a ring. $R_{20}$ or $R_{11}$ may also be bonded to $R_{18}$ to form a ring. M' represents a hydrogen atom or a cation.

Formula [VIII]

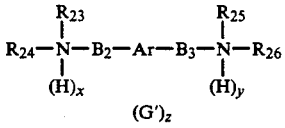

In the formula [VIII], Ar represents a divalent aryl group or a divalent organic group having an aryl group combined with an oxygen atom and/or an alkylene group, $B_2$ and $B_3$ each represent a lower alkylene group, $R_{23}$, $R_{24}$, $R_{25}$ and $R_{26}$ each represent a hydroxy-substituted lower alkyl group, x and y each represent 0 or 1.

G' represents an anion, and z represents 0, 1 or 2.

Formula [IX]

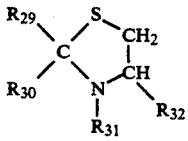

In the formula [IX], $R_{29}$ and $R_{30}$ each represent hydrogen atom, an alkyl group, an aryl group or a heterocyclic group, $R_{31}$ represents hydrogen atom or an alkyl group, and $R_{32}$ represents a carboxy group.

As representative examples of the compounds, imidazoles and derivatives thereof represented by the above formulae [I] to [IX], there may be included (I-1) to (I-10), (II-1) to (II-27), (III-1) to (III-15), (IV-1) to (IV-3), (V-1) to (V-23), (VI-1) to (VI-17), (VII-1) to (VII-15), (VIII-1) to (VIII-7), (IX-1) to (IX-5), (A-1) to (A-8) as disclosed in Japanese Patent Application No. 32501/1988, pages 17 to 39.

These compounds are compounds generally used as bleaching promotors.

These bleaching promotors may be used either alone or in combination of two or more kinds, and may be added generally in an amount of about 0.01 to 100 g per one liter of the bleaching solution to obtain favorable results. However, generally speaking, when the amount added is excessively small, the bleaching promoting effect is small, while when the amount added is excessively large than is necessary, the precipitates may be sometimes formed to contaminate the light-sensitive silver halide color photographic material. Hence, the amount should be preferably 0.05 to 50 g, more preferably 0.05 to 15 g, per one liter of the bleaching solution.

When a bleaching promotor is added, it may be also added and dissolved as such, but generally dissolved previously in water, an alkali, an organic acid, etc. before addition and, if necessary, it can be also dissolved by use of an organic solvent such as methanol, ethanol, acetone, etc. before addition.

The bleaching solution of the present invention can be used at pH 2 to 5.5, preferably at 3.0 to 5.0. The temperature for processing used may be 20° C. to 45° C., but preferably 25° C. to 42° C.

The bleaching solution of the present invention is generally used with addition of a halide such as ammonium bromide. The amount of the bromide may be small as 2.0 mole/liter or less, preferably 0.5 to 1.5 mole/liter, because the bleaching agent in the present invention has strong oxidizing power and also has little tar-like property.

In the bleaching solution of the present invention, it is possible to incorporate pH buffers comprising various salts such as boric acid, borax, sodium hydroxide, potassium hydroxide, sodium carbonate, potassium carbonate, sodium bicarbonate, potassium bicarbonate, acetic acid, sodium acetate, ammonium hydroxide, etc. alone or in combination of two or more kinds.

In the present invention, it is preferable to use as the pH buffer acetic acid which lowers bleaching fog and is also low in cost. A preferable amount of acetic acid may be 0.1 to 3 mole/liter, particularly preferably 0.4 to 2 mole/liter. If the amount of acetic acid is lower, the bleaching fog will be increased, while if it is higher, desilverizability will be lowered.

In the present invention, it is preferable to use a nitrate as the embodiment. When used in combination with the bleaching agent of the present invention, particularly its effect is great to prevent formation of ferrous complex, thereby solving leuco dye problem. Further, there is the anticorrosive effect, providing a great advantage in cost.

The nitrate may be used in an amount ranging from 0.1 to 3 mol/liter, preferably from 0.3 to 2 mol/liter.

Further, it is possible to incorporate various fluorescent brighteners, defoaming agents, surfactants or antifungal agents.

A preferable amount replenished of the bleaching solution according to the present invention may be 20 ml to 500 ml, particularly preferably 30 ml to 350 ml, further particularly preferably 40 ml to 300 ml, most preferably 50 ml to 250 ml, per 1 $m^2$ of the light-sensitive silver halide color photographic material.

By low replenishing, the effect of the present invention is made more remarkable.

Further, from the standpoint of reducing pollution, the bleaching solution and the solution having fixing ability described below can be used as a bleaching solution or bleach-fixing solution for a different kind of light-sensitive material, for example, color paper comprising primarily silver chloride, silver chlorobromide emulsion. When used, they can be used as such as a bleaching solution or a bleach-fixing solution as a tank solution or a replenishing solution, however, preferably be used after subjecting to direct or indirect treatment by use of an anion exchange resin or silver recovery apparatus.

In the present invention, from the standpoint of rapid processing, preferably after processing with a bleaching solution, subsequently processing is done with a fixing solution or a bleach-fixing solution.

In the following, preferable specific processing steps of the processing method according to the present invention are shown:

(1) Color developing-bleaching-fixing-water washing
(2) Color developing-bleaching-fixing-water washing-stabilizing
(3) Color developing-bleaching-fixing-stabilizing
(4) Color developing-bleaching-fixing-first stabilizing-second stabilizing
(5) Color developing-bleaching-bleach.fixing-water washing
(6) Color developing-bleaching-bleach.fixing-water washing-stabilizing
(7) Color developing-bleaching-bleach.fixing-stabilizing
(8) Color developing-bleaching-bleach.fixing-first stabilizing-second stabilizing.

Among these steps, above all (3), (4), (5), (7), (8) are preferred, particularly (3), (4), (5), most preferably (3).

The processing solution having fixing ability in the present invention is a fixing solution or a bleach.fixing solution, and, the processing solution which exhibits markedly the effect of the present invention is preferably a fixing solution.

The processing solution having fixing ability according to the present invention is required to contain at least one mole/liter or more of a thiosulfate. Although it has been known that fixability can be promoted by increasing the amount of thiosulfate for rapid processing, it has been entirely unexpected that fixability is markedly inhibited by a small amount of running or storage when the bleaching agent of the present invention is used in the bleaching solution.

The concentration of thiosulfate in the processing solution having fixing ability of the present invention may be preferably 1.3 mole/liter or more, particularly 1.5 to 3 mole/liter. If the concentration of the thiosulfate is too high, insufficiency of fixing will be contrariwise generated.

As the thiosulfate, for example, potassium thiosulfate, sodium thiosulfate, ammonium thiosulfate, etc. may be included, preferably ammonium thiosulfate.

As the fixing agent, other than thiosulfates, compounds which react with silver halide to form water-soluble complexes, for example, thiocyanates such as potassium thiocyanate, sodium thiocyanate, ammonium thiocyanate, or thiourea, thioether, etc. may be included.

In addition to these fixing agents, there can be included pH buffers comprising various salts including sulfites such as ammonium sulfite, potassium sulfite, ammonium bisulfite, potassium bisulfite, sodium bisulfite, ammonium metabisulfite, potassium metabisulfite, sodium metabisulfite, etc., boric acid, borax, sodium hydroxide, potassium hydroxide, sodium carbonate, potassium carbonate, sodium bicarbonate, potassium bicarbonate, acetic acid, sodium acetate, ammonium hydroxide, etc. alone or in combination of two or more kinds.

Further, for promoting fixability, it is desirable to incorporate a large amount of rehalogenating agent of an alkali halide or an ammonium halide, such as potassium bromide, sodium bromide, sodium chloride, ammonium bromide, etc. Also, it is possible to add suitably those generally known to be added in fixing solution and bleach-fixing solution, including pH buffers such as borate, oxalate, acetate, carbonate, phosphate, etc., alkylamines, alkanolamines, polyethylene oxides, etc.

In the present invention, for enhancing the activity of the bleaching solution or bleach-fixing solution, blowing of air or blowing of oxygen into the processing bath or the processing replenishing solution storage tank may be performed, if desired, or alternatively an appropriate oxidizing agent, such as hydrogen peroxide, hydrobromide, persulfate, etc. may be suitably added.

In practicing the method of the present invention, silver may be also recovered according to a known method from the fixing solution or the bleach-fixing solution. For example, the electrolytic method (described in French Patent 2,299,677), the precipitation method (described in Japanese Unexamined Patent Publication No. 73037/1977, German Patent 2,331,220), the ion-exchange method (described in Japanese Unexamined Patent Publication No. 17114/1976) and the metal substitution method (described in U.K. Patent 1,353,805), etc. can be effectively utilized.

Such silver recovery may be particularly preferably performed by way of in-line from the tank solution for further better rapid processing aptitude, but silver may be also recovered from the overflow waste liquor for re-use.

The fixing solution and the bleach-fixing solution according to the present invention will exhibit better the intended effect of the present invention, when its amount replenished is 800 ml or less per 1 $m^2$ of the light-sensitive material. Above all, good results can be obtained when it is 20 to 650 ml, particularly 30 to 400 ml, per 1 $m^2$ of the light-sensitive material.

Also, the effect of the present invention is more promoted when the fixing solution and the bleach-fixing solution of the present invention contains 0.1 to 10 g/liter of an iodide (ammonium iodide, potassium iodide, sodium iodide, lithium iodide, etc.) therein.

Particularly good results can be obtained in the case of 0.3 to 5 g/liter, above all particularly 0.5 to 3 g/liter, most preferably 0.8 to 2 g/liter.

When the fixing solution or the bleach-fixing solution according to the present invention is used with addition of a compound represented by the formula [FA] or a compound of the group of compounds [FB] shown below, not only the objective effect of the present invention can be well exhibited, but also there is added another effect that the sludge generated during processing of a small amount of light-sensitive materials over a long term is extremely little, and therefore it can be more preferably used in the present invention.

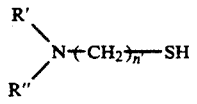

Formula [FA]

In the formula [FA], R′ and R″ each represent hydrogen atom, an alkyl group, an aryl group, an aralkyl group or a nitrogen-containing heterocyclic ring. n′ represents 2 or 3.

Specific exemplary compounds represented by the formula [FA] are shown below.

| No. | R′ | R″ | n′ |
|---|---|---|---|
| FA-1 | iso-$C_3H_7$— | H | 2 |
| FA-2 | n-$C_4H_9$— | H | 2 |
| FA-3 | iso-$C_4H_9$— | H | 2 |
| FA-4 | sec-$C_4H_9$— | H | 2 |
| FA-5 | ter-$C_4H_9$— | H | 2 |
| FA-6 | CH=CH$CH_2$— | H | 2 |
| FA-7 | n-$C_6H_{13}$— | H | 2 |
| FA-8 | n-$C_8H_{17}$— | H | 2 |
| FA-9 | n-$C_{10}H_{21}$— | H | 2 |
| FA-10 | 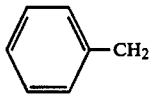 | H | 2 |
| FA-11 | 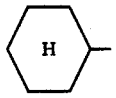 | H | 2 |
| FA-12 | $C_2H_5$— | $C_2H_5$— | 2 |
| FA-13 | n-$C_3H_7$— | n-$C_3H_7$— | 2 |
| FA-14 | iso-$C_3H_7$— | iso-$C_3H_7$— | 2 |
| FA-15 | n-$C_4H_9$— | n-$C_4H_9$— | 2 |
| FA-16 | iso-$C_4H_9$— | iso-$C_4H_9$— | 2 |
| FA-17 | sec-$C_4H_9$— | sec-$C_4H_9$— | 2 |
| FA-18 | n-$C_5H_{11}$— | n-$C_5H_{11}$— | 2 |
| FA-19 | iso-$C_5H_{11}$— | iso-$C_5H_{11}$— | 2 |
| FA-20 | $CH_2$=CH—$CH_2$— | $CH_2$=CH$CH_2$— | 2 |
| FA-21 | $CH_3$— | $CH_3$— | 2 |
| FA-22 | HO$CH_2CH_2$— | H | 2 |
| FA-23 | HO$CH_2CH_2$— | $CH_3$— | 2 |
| FA-24 | 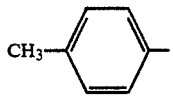 | H | 2 |
| FA-25 | 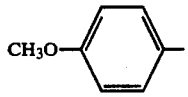 | H | 2 |
| FA-26 | 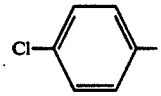 | H | 2 |
| FA-27 | $C_2H_5$— | $CH_3$— | 2 |
| FA-28 | $C_2H_5$— | $C_3H_7$— | 2 |
| FA-29 | H | H | 2 |
| FA-30 | $CH_2$=CH—$CH_2$— | $C_2H_5$— | 2 |
| FA-31 | 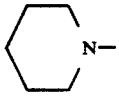 | | 2 |

-continued

| No. | R' | R'' | n' |
|---|---|---|---|
| FA-32 | | 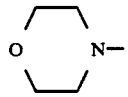 | 2 |
| FA-33 | | 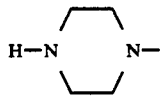 | 2 |
| FA-34 | | 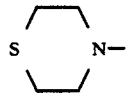 | 2 |
| FA-35 | | 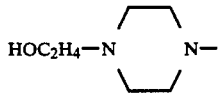 | 2 |
| FA-36 | | 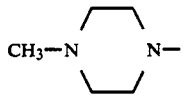 | 2 |
| FA-37 | $C_2H_5$— | $C_2H_5$— | 3 |
| FA-38 | $HSCH_2CH_2$— | $HSCH_2CH_2$— | 2 |
| FA-39 | $HSCH_2CH_2$— | HOOC—$CH_2$— | 2 |

These compounds represented by the formula [FA] can be synthetized according to the general methods as described in U.S. Pat. Nos. 3,335,161 and 3,260,718.

| Compound group [FB] | |
|---|---|
| FB-1 | thiourea |
| FB-2 | ammonium iodide |
| FB-3 | potassium iodide |
| FB-4 | ammonium thiocyanate |
| FB-5 | potassium thiocyanate |
| FB-6 | sodium thiocyanate |
| FB-7 | thiocyanocatechol |

These compounds represented by the above formula [FA] and the compounds of the group [FB] may be used either individually or as a combination of two or more compounds. For example, thiourea, ammonium thiocyanate and ammonium iodide, thiourea and ammonium thiocyanate, (FA-12) and thiourea, (FA-12) and ammonium thiocyanate, (FA-12) and ammonium iodide, (FA-12) and (FA-32), (FA-12) and (FA-38), etc. may be included as preferably examples. Among them, most preferred are (FB-1) and (FB-4).

Also, the amount of the compound represented by the formula [FA] and the compound of the compound group [FB] added may be in the range of 0.1 to 200 g per one liter of the processing solution to give favorable results. Above all, an amount in the range of from 0.2 to 100 g is preferred, and from 0.5 to 50 g is particularly preferred.

In the fixing solution and the bleach-fixing solution according to the present invention, from the standpoint of the objective effect of the present invention, a sulfurous acid adduct may be preferably used.

As the compound capable of forming a stable sulfurous acid adduct with sulfite ions, for example, compounds having aldehyde group, compounds containing cyclic hemiacetal, compounds having α-dicarbonyl group, compounds having nitrile group, etc. may be included, but the compounds represented by the formulae [A-1] and [A-II] may be particularly preferably used.

Formula [A-I]

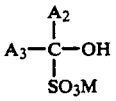

Formula [A-II]

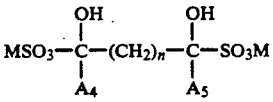

$A_2$, $A_3$, $A_4$, $A_5$ each represent hydrogen atom, an alkyl group having 1 to 6 carbon atoms, a formyl group, an acyl group or an alkenyl group. The alkyl group having 1 to 6 carbon atoms is inclusive of straight and branched ones, as exemplified by methyl, ethyl, n-propyl, iso-propyl, n-butyl, n-valeryl, iso-valeryl, hexyl, iso-hexyl groups, which may be also substituted, specifically with substitutents, including formyl groups (e.g. formylmethyl, 2-formylethyl and the like), amino groups (e.g. aminomethyl, aminoethyl and the like), hydroxyl groups (e.g. hydroxymethyl, 2-hydroxyethyl, 2-hydroxypropyl and the like), alkoxy groups (e.g. methoxy, ethoxy and the like), halogen atoms (e.g. chloromethyl, trichloromethyl, dibromomethyl and the like), etc.

As the alkenyl group, there are substituted and unsubstituted groups, and unsubstituted groups may include vinyl, 2-propenyl groups, etc., and examples of substituted groups may include 1,2-dichloro-2-carboxyvinyl, 2-phenylvinyl groups, etc.

EXEMPLARY COMPOUNDS

AO-1 formaldehyde sodium bisulfite
AO-2 acetaldehyde sodium bisulfite
AO-3 propionaldehyde sodium bisulfite
AO-4 butylaldehyde sodium bisulfite
AO-5 succinicaldehyde sodium bisulfite
AO-6 glutaraldehyde sodium bisulfite
AO-7 β-methylglutaraldehyde bisodium bisulfite
AO-8 maleic dialdehyde bisodium bisulfite In addition to the above aldehyde type sulfite adducts, compounds capable of forming a stable sulfite adduct with a sulfite ion include the following compounds.

AO-9

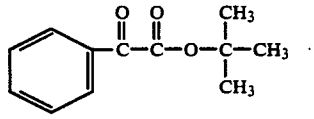

AO-10

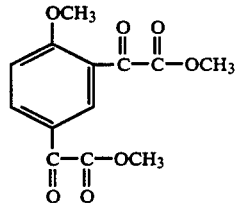

-continued

AO-11

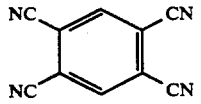

AO-12

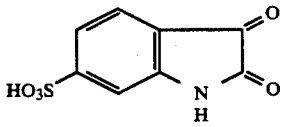

AO-13

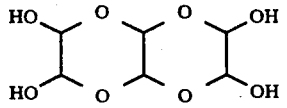

AO-14

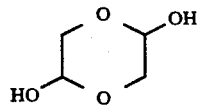

AO-15

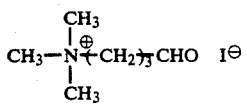

These sulfurous adduct compounds or a sulfurous acid and a stable sulfurous adduct may be preferably used in an amount ranging 0.1 to 80 g, more preferably 0.5 to 40 g per 1 liter of the processing solution.

However, hen a sulfurous acid and a compound capable of forming a stable sulfurous adduct are used, it is preferable to form the sulfurous adduct previously before addition to the processing solution.

The processing time of the bleaching solution and the processing solution having fixing ability (fixing solution or bleach.fixing solution) according to the present invention may be preferably 3 minutes and 45 seconds as the total, and the total time may be more preferably 20 seconds to 3 minutes and 20 seconds, particularly preferably 40 seconds to 3 minutes, above all particularly preferably 60 seconds to 2 minutes and 40 seconds, to exhibit well the objective effect of the present invention.

The above bleaching time can be selected as desired within the above total time, but for the effect of the present invention, may be above all preferably not longer than 1 minute and 30 seconds, particularly 10 seconds to 70 seconds, above all preferably 20 seconds to 55 seconds. The processing time of the processing solution having fixing ability can be selected as desired, but from the standpoint of the effect of the present invention, may be preferably 3 minutes and 10 seconds or less, particularly preferably 10 seconds to 2 minutes and 40 seconds, above all particularly preferably 20 seconds to 2 minutes and 10 seconds.

In the processing method of the present invention, it is preferable to impart compulsory solution stirring to the bleaching solution, the fixing solution and the bleach.fixing solution. This is not only because of preventing bleaching fog which is the objective effect of the present invention, but also from the standpoint of rapid processing aptitude.

Here, compulsory liquid stirring does not mean conventional diffusion movement of liquid, but stirring compulsorily liquid by application of a stirring means.

Compulsory stirring means may include the following methods:

1. the high pressure spray treatment method or the blowing stirring method;
2. the air bubbling treatment method;
3. the sonication oscillation treatment method;
4. the vibration treatment method.

The high pressure spray treatment method refers to a system in which treatment is conducted by blowing a treating solution against a light-sensitive material directly in a treating solution through a spray nozzle by application of a discharging pressure of 0.1 kg/cm$^2$ or more, the blowing stirring method refers to a system in which treatment is conducted by blowing a treating solution against a light-sensitive material directly in the treating solution by application of a discharging pressure of 0.1 kg/cm$^2$ through a nozzle, and as the pressure source, a pressure pump or a liquid delivery pump may be generally employed. As the pressure pump, there may be included plant jar pump, gear pump, magnet pump, cascade pump, and, for example, 15-LPM Model, 10-BFM Model, 20-BFM Model, 25-BFM Model, etc. manufactured by Maruyama Seisakusho are known as examples thereof.

As the liquid delivery pump, there may be included, for example, MD-30 Model, MO-56 Model, MDH-25 Model, MDK-32 Model manufactured by Iwaki.

On the other hand, the nozzle and the spray nozzle include the direct progress type, the fan type, the circular type, the whole surface type, the annular type, etc., and the effect is more as the impact force is stronger and more fine vibration is given to the light-sensitive material to be treated. The impact force of spray is determined primarily by the flow rate (liter/min) and the spray pressure (Kg/cm$^2$). Accordingly, a pressurization device is required, which can adjust the pressure in proportion to the number of sprays so that the effect can be sufficiently exhibited. The most preferably pressure may be 0.3 to 10 kg/cm$^2$, and if the pressure is lower than this range, no effect can be obtained, while if it is too large, the light-sensitive material may be sometimes damaged or broken.

Next, the air bubbling treatment method is a method in which a sparger is provided at the bottom of the lower conveying roller of the processing solution tank, air or an inert gas is delivered to the sparger, the light-sensitive material is vibrated by the bubbles discharged through its mouth, and further the processing solution is brought into contact effectively with the surface, the back and the side of the light-sensitive material.

The material of the sparger may be suitably anti-corrosive, such as rigid polyvinyl chloride, stainless steel coated with polyethylene, sintered metal, etc., and the perforration diameter may be such that the bubbles discharged may be 2 mm to 30 mm, preferably 5 mm to 15 mm to give better results. As the method for delivering air, there may be included, for example, the Babycon manufactured by Hitachi Seisakusho (0.4 KW, BU7TL), an air pump such as Air Pump manufactured by Iwaki (Ap 220 Model), etc. The amount of the air is required to be 2 liters/min. to 30 liters/min. per one rack conveyed of the automatic developing machine, preferably 5 liters/min. to 20 liters/min. to give better results. The amount of the air or the inert gas must be controlled depending on the size of the processing solution tank or the light-sensitive material, and it is preferable to deliver air or inert gas in an amount so that the vibration width of the light-sensitive material by the bubbles may be 0.2 mm to 20 mm.

Next, the sonication oscillation treatment method is a method in which a sonication oscillating machine is provided in the space at the bottom or the side wall within the processing solution tank of the automatic developing machine and sonication is irradiated on the light-sensitive material to enhance developing acceleration efficiency. For example, the magnetic distortion type nickel vibrator (Horn type) which is produced by Choonpa Kogyo K.K., the magnetic distortion type barium titanate vibrator (Holder type), etc. may be employed.

As the vibrator frequency of the sonication oscillator, 5 to 1000 KHz may be employed, particularly preferably 10 to 50 KHz with respect to the objective effect of the present invention and also damage of the material of the automatic developing machine. As the method for irradiating sonication onto the light-sensitive material, it may be either irradiated directly onto the light-sensitive material or indirectly with provision of a reflecting plate, but direct irradiation is preferred because sonication will be attenutated in direct proportion to the irradiation distance. The irradiation time may be preferably at least one second. In the case of partial irradiation, it may be effected at either the initial stage, the medium stage and the later stage of the treatment step.

Further, the vibration treatment method is a method in which dipping treatment is conducted effectively by giving vibration to the light-sensitive material at the middle portion between the upper roller and the lower roller in the processing solution tank of the automatic developing machine. As the vibrator of the vibration source, for example, V-2B, V-4B Models, etc. manufactured by Shinko Denki may be generally employed.

The vibrator may be provided by fixing the vibrator at the upper part of the dipping processing tank of the automatic developing machine so as to apply the vibrating element against the back of the light-sensitive material. The vibration number of the vibrating element should be preferably 100 to 10000 times/min. The most preferable range is 500 to 6000 times/min. The amplitude of the light-sensitive material may be 0.2 to 30 mm, preferably 1 to 20 mm. If it is lower than this range, there is no effect, while if it is too large, the light-sensitive material may sometimes suffer from damage. The number of the vibrating elements provided may differ depending on the size of the automatic developing machine, but preferable effect can be obtained if at least one is provided for each processing tank.

Further, it is important to perform compulsory stirring within 10 seconds after the light-sensitive material is dipped in a processing solution, preferably within 5 seconds from the standpoint of preventing bleaching fog.

In the present invention, the time for processing the above light-sensitive silver halide color photographic material with said color developer may be preferably 180 seconds or shorter, more preferably 150 seconds or shorter, further preferably 20 to 150 seconds, further preferably 30 to 120 seconds, further preferably 40 to 100 seconds.

In the present invention, by processing the above light-sensitive silver halide color photographic material within a short time as specified above, surprisingly, not only the effect of the present invention can be exhibited, but also the graininess of the dye image obtained can be also improved.

Further, in the processing method of the light-sensitive silver halide color photographic material of the present invention, the color developer is a color developer containing preferably $1.5\times10^{-2}$ mole or more of an aromatic primary amine type color developing agent per one liter of said processing solution. More preferably, the color developer should be one containing $2.0\times10^{-2}$ mole/liter or more, further preferably $2.5\times10^{-2}$ to $2\times10^{-1}$ mole/liter of the above developing agent.

Most preferably, it may be contained in an amount ranging from $3\times10^{-2}$ to $10^{-1}$ mole.

By activating the above light-sensitive photographic material with such color developing agent at a high concentration, an image excellent in sharpness and improved in graininess can be obtained by the short time processing as described above. Particularly, the effect is marked in the magenta dye image.

In the following, the color developing agent of the color developer preferably used in the present invention is to be described.

The aromatic primary amine type developing agent to be used in the above preferable color developer includes known ones used widely in various color photographic processes.

These developing agents include aminophenol type and p-phenylenediamine type derivatives. These compounds may be used generally in the form of salts, for example, hydrochlorides or sulfates, for stability rather than in the free state.

Examples of the aminophenol type developer may include o-aminophenol, p-aminophenol, 5-amino-2-oxytoluene, 2-amino-3-oxy-toluene, 2-oxy-3-amino-1,4-dimethylbenzene and the like.

In the present invention, for exhibiting better the effect of the present invention and also for improving the crystal precipitability onto the color developing layer inner wall of the automatic developing machine, the aromatic primary amine color developing agent particularly useful in the present invention is an aromatic primary amine color developing agent having an amine group, which has at least one water-soluble group, particularly preferably a compound represented by the following formula [E].

Formula [E]

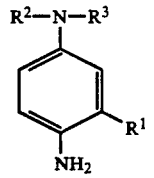

In the formula [E], $R^1$ represents hydrogen atom, a halogen atom or an alkyl group, said alkyl group representing a straight or branched alkyl group having 1 to 5 carbon atoms, which may also have a substituent.

$R^2$ and $R^3$ each represent hydrogen atom or an alkyl group or an aryl group, and these groups may also have substituents. At least one of $R^2$ and $R^3$ is an alkyl group or $-[(CH_2)_q-O-]_p-R^4$ which is substituted with water-soluble group such as hydroxyl, carboxylic acid, sulfonic acid, amino, sulfonamide groups or etc. This alkyl group may further have a substituent.

$R^4$ represents hydrogen atom or an alkyl group, and the alkyl group represents a straight or branched alkyl group having 1 to 5 carbon atoms, p and q representing an integer of 1 to 5.

In the following, the compounds represented by the above formula [E] are shown, which are not limitative of the present invention.

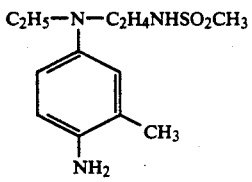

(E-1)

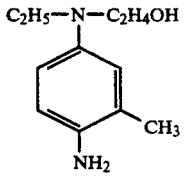

(E-2)

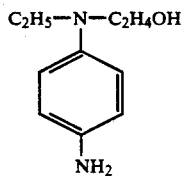

(E-3)

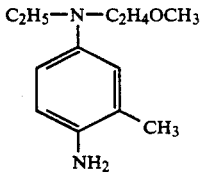

(E-4)

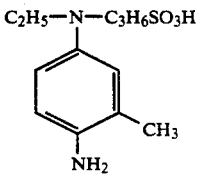

(E-5)

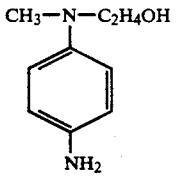

(E-6)

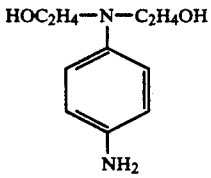

(E-7)

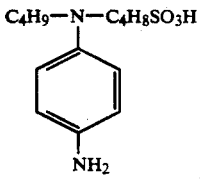

(E-8)

-continued

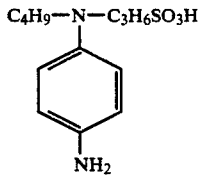

(E-9)

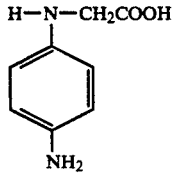

(E-10)

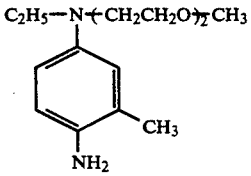

(E-11)

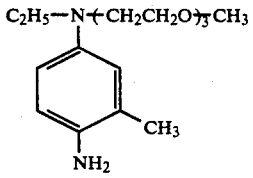

(E-12)

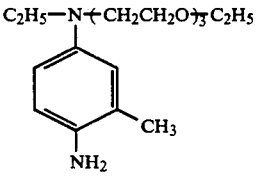

(E-13)

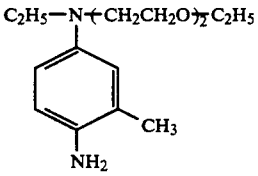

(E-14)

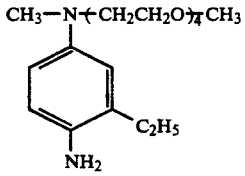

(E-15)

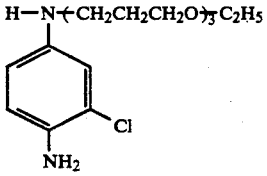

(E-16)

The p-phenylenediamine derivatives represented by the formula [E] can be used as salts of organic acids and inorganic acids, for example, as hydrochlorides, sulfates, phosphates, p-toluenesulfonates, sulfites, oxalates, benzenedisulfontes, etc.

In the present invention, among the p-phenylenediamine derivatives represented by the above formula [E], above all the effect of the present invention can be better exhibited when $R_2$ and/or $R_3$ is $-[(CH_2)_q-O-]_p-R^4$ (p, q and $R^4$ are the same as defined above).

Preferable compounds to be used in the color developer used in the present invention may include sulfites, hydroxylamines, and hydrazine derivatives, hydroxylamine derivatives, monoamines, diamines, polyamines, hydroxy succharides, alkanolamines disclosed in Japanese Unexamined Patent Publication No. 186947/1989 can be used as a preservative. Further, in the color developer used in the present invention, development inhibitors or stabilizer described below are preferably used. As the above sulfites, there may be included sodium sulfite, sodium hydrogen sulfite, potassium sulfite, potassium hydrogen sulfite, which may be used preferably in an amount ranging from 0.1 to 40 g/liter, more preferably from 0.5 to 10 g/liter.

The above hydroxylamine is used as counter-salt for hydrochloride, sulfate, etc., and used preferably in an amount ranging from 0.1 to 40 g/liter, further preferably from 0.5 to 10 g/liter. Further, the development inhibitor preferably used in the above color developer may include, in addition to halides such as sodium chloride, potassium chloride, sodium bromide, potassium bromide, sodium iodide, potassium iodide, etc,-organic inhibitors, and they should be preferably used in an amount ranging from 0.005 to 20 g/liter, more preferably from 0.01 to 5 g/liter.

As the above organic inhibotor preferably used in the practice of the present invention, there can be included nitrogen-containing heterocyclic compounds, compounds containing mercapto groups, aromatic compounds, onium compounds and compounds having iodine atoms in the substituents, and specific examples of these are shown below.

However, available compounds are not limited to those shown below.

(Exemplary compounds)

(Z-1)

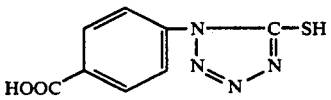

(Z-2)

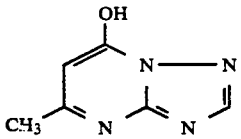

(Z-3)

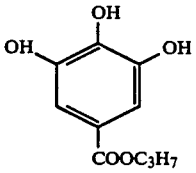

(Z-4)

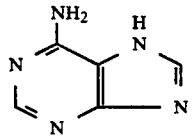

-continued (Exemplary compounds)

(Z-5)

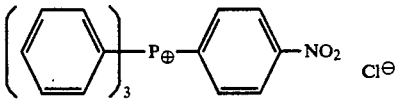

(Z-6)

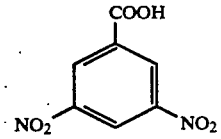

(Z-7)

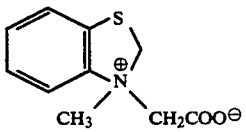

(Z-8)

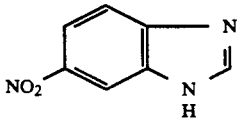

(Z-9)

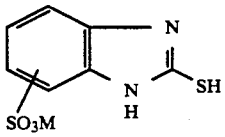

(Z-10)

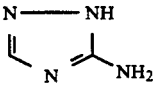

(Z-11)

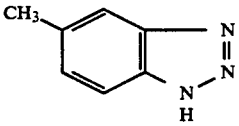

(Z-12)

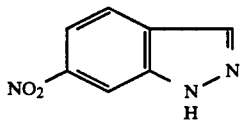

(Z-13)

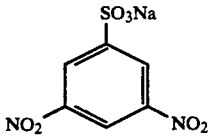

(Z-14)

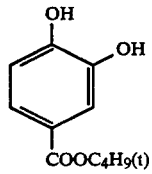

(Z-15)

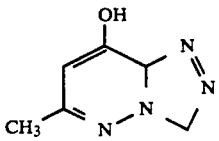

Further, in practicing the present invention, the organic inhibitors represented by the formulae [R-I] to [R-XIII] described on page 96 to page 100 in Japanese Patent Application No. 12781/1986 can be used, and by using said organic inhibitor with the above inhibitor of the present invention, the effect of the present invention can be further effectively exhibited.

Also, the inhibitors in the present invention are as described above, but further specific examples may include (Z-1) to (Z-3), (Z-6), (Z-8) to (Z-13), (Z-15) to (Z-17), (Z-19), (Z-22) to (Z-25), (Z-29), (Z-31) to (Z-38), (Z-40), (Z-40), (Z-41), (Z-43) to (Z-64), and (Z-66) to (Z-73) on page 101 to page 113 in the specification of the above Japanese Patent Application No. 12781/1986.

In the color developer to be used in the present invention, further various components conventionally added can be also incorporated as desired, for example, alkali agents such as sodium hydroxide, sodium carbonate, etc., alkali metal thiocyanates, alkalk metal halides, benzyl alcohol, water softeners and thickeners and development accelerators, etc.

As the additives other than those to be added into the above color developing solution, there are stain preventives, sludge preventives, preservatives, interlayer effect accelerators, chelating agents, etc.

The color developer of the present invention should be preferably used at pH 9 or higher, particularly preferably at pH 9 to 13.

As the processing temperature of the color developer, for exhibiting better the effect suited for the object of the present invention, 35° C. or higher is preferable, particularly preferably within the range of 38° C. to 60° C. From the standpoint of rapid processing, higher the temperature is, better the effect can be exhibited, however from the standpoint of stability in processing, the temperature is preferably 40° C. to 50° C.

In addition to those mentioned above, the processing methods of the present invention are not particularly limited, but all processing methods are applicable.

The light-sensitive material according to the present invention may be of the inner type developing system in which the couplers are contained in the light-sensitive material (see U.S. Pat. Nos. 2,376,679, 2,801,171), or otherwise of the external type developing system in which couplers are contained in the developer (see U.S. Pat. Nos. 2,252,718, 2,592,243, 2,590,970). As the couplers, any of those generally known in this field of the art can be used. For example, as the cyan coupler, those outside the scope of the present invention may be also used in combination, including as said cyan coupler to be used in combination those having a basic structure of naphthol or phenol and being capable of forming indoaniline dyes through coupling. As the magenta coupler, those having 5-pyrazolone ring having active methylene group as the skeltal structure and those of the pyrazoloazole type, and as the yellow coupler, either of those having or not having substitutuents at the coupling positions of the benzoylacetanilide, pivalylacetanilide, acylacetanilide structure, can be used. Thus, as the coupler, both of the so called two-equivalent type coupler and the four-equivalent type coupler are applicable.

In the present invention, for exhibiting better the objective effect of the present invention, the cyan couplers shown by the formulae [C-A]-[C-C] disclosed on pages 148 to 196 of Japanese Patent Application No. 32501/1988 may be preferably used, and specific exemplary compounds of these cyan couplers may include (C-1)-(C-46) described on pages 159-173 in Japanese Patent Application No. 32501/1988 and (C-51)-(C-118) described on pages 178-196 in the same specification.

Next, as the magenta coupler to be preferably used in the present invention for preventing bleaching fog, the magenta couplers represented by the formula [M-I] described on pages 197-207 in Japanese Patent Application No. 32051/1988 may be included, and specific exemplary compounds of these magenta couplers may include (M-1)-(M-76) described on pages 208 to 227 in Japanese Patent Application No. 32051/1988, and the magenta couplers No. 1 to No. 223 described on pages 66 to 122 in Japanese Patent Application No. 9791/1986.

The light-sensitive silver halide color photographic material to be used in the present invention exhibits better the objective effect of the present invention, when containing a compound capable of releasing a bleaching accelerator (hereinafter called a BAR compound) through the reaction with the oxidized product of the color developing agent in at least one layer of the silver halide emulsion layer.

As the BAR compound preferably used, the compounds represented by the formulae [BAR-A] and [BAR-B] described on pages 233 to 252 in Japanese Patent Application No. 32501/1988 may be included, and specific exemplary compounds of these BAR compounds may include the compounds (1)-(77) described on pages 252 to 274 in Japanese Patent Application No. 32501/1988.

The silver halide emulsion used in the present method for processing light-sensitive silver halide emulsion may include silver chloride, silver bromide, silver chlorobromide, silver iodobromide and silver chlorobromoiodide, however, in practicing the present invention, silver chlorobromide emulsion and silver iodobromide emulsion are preferable. The silver chlorobromide emulsion is described in Japanese Unexamined Patent Publication Nos. 25643/1988, 12932/1988, 9455/1989, 79744/1989 and 77047/1989, and the details of the silver iodobromide will be described below However, when the silver iodide content in at least one of the silver halide emulsion layers is 0.5 mole % or more, Preferably within the range of 1 to 15 mole % , more preferably within the range of 1.5 to 10 mole %, excellent effects can be exhibited. Particularly, when the silver iodide content of at least one layer in the present invention is 0.5 mole % or more, the most preferable embodiment can be provided.

In the processing method of the light-sensitive silver halide color photographic material of the present invention, as the silver halide emulsion to be used, there may be preferably used a silver halide emulsion containing silver halide grains constituted of two or more phases with different silver iodide contents in which the average silver iodide content is higher than the silver iodide content in the outer peripheral phase of said grains.

In the processing method of the light-sensitive silver halide color photographic material of the present invention, higher average silver iodide content in the grains than the silver iodide content in the outer peripheral phase can be measured according to the method described below.

When the silver halide emulsion of the present invention is an emulsion containing silver halide grains with an average value of grain size/thickness of grain being less than 5, the average silver iodide content determined by the fluorescent X-ray analytical method ($J_1$) as compared with the silver iodide content of the grain surface determined by the X-ray photoelectron spectral method ($J_2$) satisfies the relationship of $J_1 > J_2$.

The grain size as herein mentioned refers to the diameter of the cicumcircle where the projected area of the grain becomes the maximum.

The X-ray photoelectron spectal method is to be described below.

Prior to measurement by the X-ray photoelectron spectral method, the emulsion is pretreated as follows. First, into the emulsion is added a pronase solution, and the mixture is stirred at 40° C. for one hour to decompose gelatin. Next, the emulsion particles are sedimented by centrifugation, and after removal of the supernatant, an aqueous pronase solution is added and gelatin decomposition is again effected under the above conditions. This sample is again subjected to centrifugation, and after removal of the supernatant, distilled water is added to redisperse the emulsion particles into distilled water, followed by centrifugation and removal of the supernatant. After repeating the water washing operation 3 times, the emulsion particles are again redispersed into ethanol. The dispersion is coated thinly on a silicon wafer subjected to mirror surface polishing to provide a sample for measurement.

For measurement according to the X-ray photoelectron spectral method, ESCA/SAM 560 Model manufactured by PHI Co., Ltd. is used as the device, and Mg-Kα ray is used as the X-ray for excitation, and the conditions of X-ray source voltage of 15 KV, X-ray source current of 40 mA and pass energy of 50 eV are employed.

For determining the surface halide composition, Ag3d, Br3d, I3d3/2 electrons are detected.

The composition ratio is calculated according to the relative sensitivity coefficient method by use of the integrated intensity of each peak. By use of 5.10, 0.81, 4.592 respectively as the relative sensitivity coefficients of Ag3d, Br3d and I3d3/2, the composition ratio is given in the atomic percent as the unit.

When the silver halide emulsion to be used in the present invention contains grains with an average value of grain size/grain thickness of less than 5, the grain size distribution should be preferably mono-dispersed. The mono-dispersed silver halide emulsion refers to one with the silver halide weight contained within the grain size range of +20% of the average grain size $\bar{\gamma}$ as the center is 60% or more of the total silver halide grain weight, preferably 70% or more, further preferably 80% or more.

Here, the average grain size $\bar{\gamma}$ is defined as the grain size $\gamma_i$ at which the product $n_i \times \gamma_i^3$ of the frequency $n_i$ of the grains having the grain size $\gamma_i$ and $\gamma_i^3$ becomes the maximum (effective numeral 3 ciphers, minimum cipher being rounded).

The grain size as herein mentioned is its diameter when it is a spherical silver halide grain, or the diameter of the circular image calculated with the same area as its projected image when it is a grain with a shape other than sphere.

The grain size can be obtained by, for example, photographing the grain to 10,000-fold to 50,000-fold by an electron microscope, and measuring the area of the grain size on the print or during projection (the number of grains measured is made indiscriminately 1000).

The particularly preferable high degree mono-dispersed emulsion of the present invention has a breadth as defined by:

$$\frac{\text{standard deviation}}{\text{average grains size}} \times 100 = \text{breadth of distribution (\%)}$$

of 20% or less, further preferably 15% or less.

Here, the average grain size and the grain size standard deviation are to be determined from $\gamma_i$ as defined above.

When the silver halide emulsion to be used in the present invention is a flat plate silver halide emulsion with an average value of grain size/grain thickness of 5 or more, the average silver iodide content ($J_1$) determined by the fluorescent X-ray analytical method as compared with the average value ($J_3$) of the measured values of silver iodide measured on the silver halide crystals apart by 80% or more from the center with respect to the grain diameter direction of the silver halide grain by use of the X-ray analysis method satisfies the relationship of $J_1 > J_3$.

The X-ray microanalysis method is to be described below.

Silver halide grains are dispersed on a grid for electron microscope observation having an energy dispersion type X-ray analytical device mounted on an electron microscope, and with a magnification being set by liquid nitrogen cooling so that one grain may come into the CRT vision field, the intensities of the Aglα, ILα lines are integrated for a predetermined time. By use of the ILα/Aglα intensity ration and the calibration curve previously prepared, the silver iodide content can be calculated.

In a flat plate silver halide emulsion with an average value of grain size/grain thickness of 5 or more, the average value of grain size/grain thickness should be preferably 6 to 100, more preferably 7 to 50.

In the silver halide emulsion according to the present invention with an average value of grain size/grain thickness less than 5, the silver iodide content ($J_2$) according to the X-ray photoelectron spectral method should be preferably 6 to 0 mole %, more preferably 5 to 0 mole %, particularly preferably 4 t 0.01 mole %.

In the flat plate silver halide emulsion according to the present invention with an average value of grain size/grain thickness of 5 or more, the average value ($J_3$) of the measured values of silver iodide contents measured on the silver halide crystals apart by 80% or more from the center with respect to the grain diameter direction of the silver halide grain according to the X-ray microanalysis method should be preferably 6 to 0 mole %, more preferably 5 to 0 mole %, particularly preferably 4 to 0.01 mole %. The average thickness of the flat plate silver halide grain should be preferably 0.5 to 0.01 μm, particularly preferably 0.3 tc 0.05 μm. The average grain size of the silver halide grains contained in the flat plate silver halide emulsion should be preferably 0.5 to 30 μm, more preferably 1.0 to 20 μm.

The silver halide emulsion with an average value of grain size/grain thickness of 5 or more as described above preferably used in the present invention should be preferably mono-dispersed, and preferably of the core/shell type. The flat plate silver halide emulsion with an average value of grain size/grain thickness of 5 or more as described above preferably used in the present invention should be preferably one having silver halide localized at the grain center.

The silver halide emulsion with an average value of grain size/grain thickness less than 5 comprises a grain structure constituted of two or more phases with different silver iodide contents, with the phase having the highest content of silver iodide (called core) comprising silver halide grains other than the outermost layer (called shell).

The inner phase (core) silver halide content having the highest silver iodide content which can be preferably used may be 6 to 40 mole %, more preferably 8 to 30 mole %, particularly preferably 10 to 20 mole %. The silver iodide content of the outermost phase should be preferably less than 6 mole %, further preferably 0 to 4.0 mole %.

The ratio of the shell portion occupied in the core/-shell type silver halide grains should be preferably 10 to 80% by volume, more preferably 15 to 70%, particularly 20 to 60%.

On the other hand, the ratio of the core portion occupied should be preferably made 10 to 80% by volume, further preferably 20 to 50% of the whole grains.

In the present invention, the content difference between the core portion with higher silver iodide content and the shell portion with lower content of the silver halide grains may be also one having a sharp boundary, or alternatively also one being varied continuously with the boundary being not necessarily evident. Also, one having an intermediate phase with an intermediate silver iodide content between the core portion and the shell portion may be preferably used.

When the silver halide grains comprise the core/shell type silver halide grains having the above intermediate layer, the volume of the intermediate layer may be preferably 5 to 60%, further 20 to 55%. The silver iodide content differences between the shell and the intermediate layer, between the intermediate layer and the core should be each preferably 3 mole % or more, with the silver iodide content difference between the shell and the core being preferably mole % or more.

The core/shell type silver halide emulsion should be preferably silver iodobromide, with its average silver iodide content being preferably 4 to 20 mole %, more preferably 5 to 15 mole %. Also, silver chloride may be also contained within a range which does not impair the effect of the present invention.

The core/shell type silver halide emulsion can be prepared according to the known methods as disclosed in Japanese Unexamined Patent Publications Nos. 177535/1984, 138538/1985, 52238/1984, 143331/1985, 35726/1985 and 258536/1985, etc.

When the core/shell type silver halide emulsion is grown starting from the seed grains as described in the method of Example in Japanese Unexamined Patent Publication No. 138538/1985, it can possibly have a silver halide composition region different from the core at the center of the grain.

In such case, as the silver halide composition of the seed grain, one having any desired composition of silver bromide, silver iodobromide, silver chloroiodobromide, silver chlorobromide, silver chloride, etc. can be used, but a silver iodoboromide with a silver iodide content of 10 mole % or less or silver bromide is preferred.

The ratio of the seed grains occupied in the whole silver halide may be preferably 50% by volume or lower, particularly preferably 10% or lower.

The distribution state of silver iodide in the above core/shell type silver halide grains can be detected by various physical measurement methods, and can be examined according to, for example, measurement of luminescence at low temperature as described in the gists of lectures at the Annual Meeting of Society of Photography of Japan, 1981, or the X-ray diffraction method.

The core/shell type silver halide grains may be normal crystals such as cubic, tetradecahedral, octahedral, may also comprise twin crystals, or mixtures of these, but preferably normal crystals.

In the flat plate silver halide emulsion with an average value of grain size/grain thickness of 5 or more and having silver iodide localized at the grain center, the high iodine containing phase at the center should be preferably 80% or less of the whole volume of the grains, particularly 60 to 10%. The silver iodide content at the center portion should be preferably 5 to 40 mole %, particularly preferably 10 to 30 mole %. The low iodine containing phase surrounding the high iodine containing phase at the center (peripheral portion) should preferably comprise a silver iodobromide having a silver iodide content of 0 to 10 mole %, more preferably 0.1 to 6.0 mole %.

The flat plate silver halide emulsion having silver iodide localized at the center can be obtained according to the known method as disclosed in Japanese Unexamined Patent Publication No. 99433/1984, etc. In the processing method of the light-sensitive silver halide color photographic material of the present invention, the average silver iodide content of the whole silver halide emulsion in the light-sensitive silver halide photographic material should be preferably 0.1 to 15 mole %, more preferably 0.5 to 12 mole %, particularly preferably 1 to 6 mole %.

In the processing method of the light-sensitive silver halide color photographic material of the present invention, the average grain size of the whole silver halide emulsion in the light-sensitive silver halide color photographic material may be preferably 2.0 μm or less, more preferably 0.1 μm to 1.0 μm, particularly preferably 0.2 μm to 0.6 μm.

In the processing method of the light-sensitive silver halide color photographic material of the present invention, the lower limit of the sum of the dry film thicknesses of the whole hydrophilic colloid layer of the light-sensitive silver halide color photographic material depends on the silver halide emulsion contained, the coupler, the oily agent, the additive, etc., and a preferable film thickness of the emulsion surface may be 5 to 18 μm, further preferably 10 to 16 μm. Also, the distance from the outermost surface of the emulsion surface to the lower end of the emulsion most approximate to the support may be preferably 14 μm or less, and to the lower end of the emulsion layer which is different in color sensitivity from said emulsion layer and approximate next to said emulsion layer to said emulsion layer preferably 10 μm or less.

As the method for making the color light-sensitive layer a thin layer, it is possible to use the method in which the hydrophilic colloid which is the binder is reduced in amount. Since a hydrophilic colloid is added for the purpose of maintaining coupler fine oil droplets, etc. dissolved in silver halide or a high boiling solvent, or preventing fog elevation due to mechanical stress, and also for preventing color turbidity due to diffusion of the developing agent oxidized product between layers, etc., its amount can be reduced within the range which does not impair those objects.

As another method for making the layer thinner, the method of using a coupler of high color formability can be used.

As other methods of making the layer thinner, there may be included the method in which the amount of the high boiling point solvent is reduced, the method in which the intermediate layer is made thinner by addition of a scavenger of the developing agent oxidized product in the intermediate layer between the layers having different color sensitivities, etc.

In the processing method of the light-sensitive silver halide color photographic material of the present invention, the sum of silver halides contained in the light-sensitive silver halide emulsion contained in all the emulsion layers of the light-sensitive silver halide color photographic material should be preferably 6.5 g/m$^2$ or less, more preferably 2.5 to 6.0 g/m$^2$ or less, further more preferably 3.0 to 5.5 g/m$^2$, particularly preferably 3.5 to 5.0 g/m$^2$.

In the processing method of the light-sensitive silver halide color photographic material of the present invention, the swelled film thickness during development of the whole hydrophilic protective colloid layer coated on the emulsion layer side on the support of the light-sensitive silver halide color photographic material should be preferably 180% to 350%, particularly preferably 200 to 300%, of the dry film thickness.

The technique for controlling the swelled film thickness is well known to those skilled in the art, and can be practiced by, for example, selecting suitably the amount, the kind of the film hardener.

As the film hardener, there can be used either singly or in combination the film hardners of the aldehyde type, the aziridine type (e.g. those described in PB Report 19,921; U.S. Pat. Nos. 2,950,197, 2,964,404, 2,983,311, 3,271,175; Japanese Patent Publication No. 40898/1971; Japanese Unexamined Patent Publications Nos. 91315/1975), the isooxazole type (e.g. those described in U.S. Pat. No. 331,609), the epoxy type (e.g. those described in U.S. Pat. No. 3,047,394; German Patent 1,085,633; U.K. Patent 1,033,518; Japanese Patent Publication No. 35495/1973), the vinyl sulfone type (e.g. those described in PB Report 19,920, German Patents 1,100,942, 2,337,412, 2,545,722, 2,635,518, 2,742,308, 2,749,260; U.K. Patent 1,251,091; Japanese Patent Applications Nos. 54236/1970, 110996/1973; U.S. Pat. Nos. 3,539,644, 3,490,911), the acryloyl type (e.g. those described in Japanese Patent Application No. 27949/1973, U.S. Pat. No. 3,640,720), the carbodiimide type (e.g. those described in U.S. Pat. Nos. 2,938,892, 4,043,818, 4,061,499; Japanese Patent Publication No. 38715/1971, Japanese Patent Application No. 15095/1974), the triazine type (e.g. those described in German Patents 2,410,973, 2,553,915; U.S. Pat. No. 3,325,287; Japanese Unexamined Patent Publication No. 12722/1977), the polymeric type (e.g. those described in U.K. Patent 822,061, U.S. Pat. Nos. 3,623,878, 3,396,029, 3,226,234, Japanese Patent Publications Nos. 18578/1972, 18579/1972, 48896/1972), otherwise the maleimide type, the acetylene type, the methansulfonic acid ester type (N-methylol type). Useful combination techniques may include the combinations as described in German Patents 2,447,587, 2,505,746, 2,514,245; U.S. Pat. Nos. 4,047,957, 3,832,181, 3,840,370; Japanese Unexamined Patent Publications Nos. 43319/1973, 63062/1975, 127329/1977; Japanese Patent Publication No. 32364/1973.

The swelled film thickness during development in the present invention is defined as the thickness when dipped in the solution shown below maintained at 38° C. for 3 minutes.

Solution for measurement of swelling degree:

| | |
|---|---|
| 4-Amino-3-methyl-N-ethyl-N-(β-hydroxyethyl)-aniline.sulfate | 4.75 g |
| Anhydrous sodium sulfite | 4.25 g |
| Hydroxylamine.½ sulfate | 2.0 g |
| Anhydrous potassium carbonate | 37.5 g |
| Sodium bromide | 1.3 g |
| Nitrilotriacetic acid.3 sodium salt (monohydrate) | 2.5 g |
| Potassium hydroxide | 1.0 g |
| (made up to one liter with addition of water) | |

The swelled film thickness can be measured according to the method described in A. Green and G. I. B. Levension, Journal of Photographic Science (J. Photgr. Sci) 20, 205 (1972).

The dry film thickness in the present specification means the film thickness measured under 23° C. and a controlled humidity of 55%. As for each film thickness, the cross-section of the dried sample is photographed with enlargement by a scanning type electron microscope for measurement of the film thickness of each layer.

As the wholly hydrophilic protective colloid layer, in addition to at least each one layer of blue-sensitive, green-sensitive and red-sensitive silver halide emulsion layers as described above, protective layers, halation prevention layers, yellow filter layers, intermediate layers, etc. provided if necessary may be included.

The layer constitution of the light-sensitive silver halide color photographic material which can exhibit particularly the effect according to the present invention may be a layer constitution, comprising colloid silver halation prevention layer (intermediate layer) red sensitive layer (intermediate layer) green sensitive layer (intermediate layer) colloid silver yellow filter layer blue-sensitive layer (intermediate layer) protective layer coated successively from the support, or further comprising colloid silver halation prevention layer (intermediate layer) red-sensitive layer (intermediate layer) green-sensitive layer (intermediate layer) blue-sensitive layer (intermediate layer) red-sensitive layer (intermediate layer) green-sensitive layer (colloid silver yellow filter layer) blue-sensitive layer (intermediate layer) protective layer coated successively from the support.

The layers in the brackets may be also omitted. Each of the above red-sensitive layer, the green-sensitive layer and the blue-sensitive layer should be preferably divided into layers of low sensitivity and high sensitivity. Also, the layer constitution having at least one of the red-sensitive layer, the green-sensitive layer and the blue-sensitive layer divided into three partial layers as described in Japanese Patent Publication No. 15495/1974, the layer constitution having the layers divided into the high sensitivity emulsion layer units and the low sensitivity emulsion layer units as described in Japanese Unexamined Patent Publication No. 49027/1976, and the layer constitution as described in German OLS 2,622,922, 2,622,923, 2622,924, 2,704,826 and 2,704,797 may be included.

Also, in the present invention, the layer constitutions as described in Japanese Unexamined Patent Publications Nos. 177551/1982, 177552/1984 and 180555/1984 are also applicable.

These silver halide emulsions may be also chemically sensitized with active gelatin; sulfur sensitizers such as allylthiocarbamide, thiourea, cystine, etc.; selenium sensitizers; reducing sensitizers such as stannous salt, thiourea dioxide, polyamine, etc.; noble metal sensitizers such as gold sensitizers, specifically potassium aurithiocyanate, potassium chloroaurate, 2-aurothio-3-methylbenzothiazolium chloride, etc. or, sensitizers of water-soluble groups of ruthenium, palladium, platinum, rhodium, iridium, etc., specifically ammonium chloropalladate, potassium chloroplatinate and sodium chloropalladate (some of these may also act as the sensitizer or the antifoggant, etc. depending on the amount) either singly or by use in combination (e.g. combination of gold sensitizer with sulfur sensitizer, combination of gold sensitizer with selenium sensitizer, etc.).

The silver halide emulsion according to the present invention may be chemically aged with addition of a sulfur containing compound, and at least one kind of hydroxytetrazaindenes and at least one nitrogen containing heterocyclic compound having mercapto group may be contained before, during or after such chemical aging.

The silver halide to be used in the present invention may be also optically sensitized by addition of an appropriate sensitizing dye in an amount of $5\times10^{-8}$ to $3\times10^{-3}$ mole based on one mole of silver halide in order to impart sensitivity to each desired photosensitive wavelength region. As the sensitizing dye, various dyes can be used, and either one or two or more kinds can be used in combination. In the present invention, sensitizing dyes advantageously used can include those as mentioned below.

More specifically, as the sensitizing dye to be used in the blue-sensitive silver halide emulsion, there may be included those as described in German Patent 929,080, U.S. Pat. Nos. 2,231,658, 2,493,748, 2,503,776, 2,519,001, 2,912,329, 3,656,959, 3,672,897, 3,694,217, 4,025,349, 4,046,572; U.K. Patent 1,242,588; Japanese Patent Publications Nos. 14030/1969, 24844/1977, etc. As the sensitizing dye to be used in the green-sensitive emulsion, there may be included cyanine dyes, melocyanine dyes or complex cyanine dyes as described in U.S. Pat. Nos. 1,939,201, 2,072,908, 2,739,149, 2,945,763, U.K. Patent 505,979, etc. as representative ones. Further, as the sensitizing dye to be used in the red-sensitive silver halide emulsion, for example, the cyanine dyes, melocyanine dyes or complex dyes as described in U.S. Pat. Nos. 2,269,234, 2,270,378, 2,442,710, 2,454,629, 2,776,280, etc. can be included as representative ones. Further, the cyanine dyes, melocyanine dyes or complex cyanine dyes as described in U.S. Pat. Nos. 2,213,995, 2,493,748, 2,519,001; German Patent 929,080, etc. can be advantageously used for the green-sensitive silver halide emulsion or the red-sensitive silver halide emulsion.

These sensitizing dyes may be used alone or alternatively combinations of these may be also used.

The light-sensitive photographic material according to the present invention may be subjected to optical sensitization according to the spectral sensitization method by using singly a cyanine or melocyanine dye or using them in combination, if necessary.

Representative spectral sensitization methods particularly preferred may include the methods as described in Japanese Patent Publications Nos. 4936/1968, 22884/1968, 18433/1970, 37443/1982, 28293/1973, 6209/1984, 12375/1978; Japanese Unexamined Patent Publications Nos. 23931/1977, 51932/1977, 80118/1979, 153926/1983, 116646/1984, 116647/1984, etc. concerning combinations of benzimidazolocarbocyanines and benzooxazolcarbocyanines.

Also concerning combinations of carbocyanines having benzoimidazole nucleus and other cyanines or melocyanines, for example, Japanese Patent Publications Nos. 25831/1970, 11114/1972, 25379/1972, 38406/1973, 38407/1973, 34535/1979, 1569/1980, 33220/1975, 38526/1975, 107127/1976, 115820/1976, 135528/1976, 104916/1977, 104917/1977, etc. may be included.

Further, concerning combinations of benzooxazolocarbocyanines (oxacarboxyanines) with other carbocyanines, for example, Japanese Patent Publications Nos. 32753/1969, 11627/1971, 1483/1982, and concerning melocyanines, for example, Japanese Patent Publications Nos. 38408/1973, 41204/1973, 40662/1975, 25728/1981, 10753/1983, 91445/1973, 116645/1984, 33828/1975, etc. may be included.

Also, concerning combinations of thiacarbocyanines with other carbocyanines, there are Japanese Patent Publications Nos. 4932/1968, 4933/1968, 26470/1970, 18107/1971, 8741/1972, Japanese Unexamined Patent Publication No. 114533/1984, etc., and further the method as described in Japanese Patent Publication No. 6207/1974 using a zeromethine or dimethinemelocyanine, monomethine or trimethincyanine and a styryl dye can be advantageously used.

For adding these sensitizing dyes into the silver halide emulsion according to the present invention, it is previously dissolved in, for example, a hydrophilic solvent such as methyl alcohol, ethyl alcohol, acetone, dimethylformamide or a fluorinated alcohol as described in Japanese Patent Publication No. 40659/1975, etc. as the dye solution before use.

The timing of addition may be at any desired timing at initiation of the chemical aging of the silver halide emulsion, during aging or on completion of aging, and may be also sometimes added in the step immediately before coating of the emulsion.

In the photographic constituent layers of the light-sensitive silver halide color photographic material according to the preset invention, dyes (AI dyes) which are water-soluble or can be decolored with the color developing solution can be added, and as said AI dyes, oxonol dyes, hemioxonol dyes, melocyanine dyes and azo dyes are included. Among them, oxonol dyes, hemioxonol dyes and melocyanine dyes are useful. Examples of available AI dyes may include those described in U.K. Patents 584,609, 1,277,429; Japanese Unexamined Patent Publications Nos. 85130/1873, 99620/1974, 114420/1984, 129537/1984, 108115/1977, 25845/1984, 111640/1984, 111641/1984; U.S. Pat. Nos. 2,274,782, 2,533,472, 2,956,079, 3,125,448, 3,148,187, 3,177,078, 3,247,127, 3,260,601, 3,540,887, 3,575,704, 3,653,905, 3,718,472, 4,070,352.

These AI dyes can be used preferably in amounts of $2\times10^{-3}$ to $5\times10^{-1}$ mole per one mole of silver in the emulsion layer.

In the light-sensitive material according to the present invention, a DIR compound can be used. Representative of DIR compounds are DIR couplers having groups capable of forming compounds having development inhibitory effect when eliminated from the active site introduced into the active site of the coupler, which are described in, for example, U.K. Patent 935,454, U.S. Pat. Nos. 3,227,554, 4,095,984, 4,149,886, etc.

The above DIR coupler has the properties that the coupler mother nucleus forms a dye when undergoing the coupling reaction with the oxidized product of the color developing agent, while releasing the development inhibitor. Also, in the present invention, there are also included the compounds which release development inhibitor but not form a dye when undergoing the coupling reaction with the oxidized product of the color developing agent as described in U.S. Pat. Nos. 3,652,345, 3,928,041, 3,958,993, 3,961,959, 4,052,213; Japanese Unexamined Patent Publications Nos. 110529/1978, 13333/1979, 161237/1980, etc.

Further, the so called timing DIR compounds can be also used in the present invention, which are compounds of which mother nucleus forms a dye or a colorless compound, while the eliminated timing group is a compound releasing the development inhibitor through the intramolecular nucleophilic substitution reaction or elimination reaction when reacted with the oxidized product of the color developing agent as described in Japanese Unexamined Patent Publications Nos. 145135/1979, 114946/1981 and 154234/1982.

Also, it is possible to use the timing DIR compounds having the timing group as describe above to the coupler mother nucleus which forms a completely diffusible dye, when reacted with the oxidized product of the color developing agent, as described in Japanese Unexamined Patent Publications Nos. 160954/1983 and 162949/1973.

The amount of the DIR compound contained in the light-sensitive material may be preferably within the range of $1\times10^{-4}$ mole to $1\times10^{-1}$ mole per one mole of silver.

Further, other than DIR compounds, compounds releasing development inhibitors with development can be also used in the present invention, including, for example, those described in U.S. Pat. Nos. 3,297,445, 3,379,529; German OLS 2,417,914; Japanese Unexamined Patent Publications Nos. 15271/1977, 9116/1978, 123838/1974, 127038/1984, etc.

In the light-sensitive silver halide color photographic material to be used in the present invention, otherwise various kinds of additives for photography can be incorporated For example, there can be used antifoggants, stabilizers, UV-ray absorbers, color staining preventives, fluorescent brighteners, color image fading preventives, antistatic agents, film hardeners, surfactants, plasticizers, humectants, etc. as described in Research Disclosure No. 17643.

In the light-sensitive silver halide color photographic material to be used in the present invention, the hydrophilic colloid to be used for preparation of the emulsion may include gelatin, gelatin derivatives, graft polymers of gelatin with other polymers, proteins such as albumin, casein, etc., cellulose derivatives such as hydroxyethyl cellulose derivatives, carboxymethyl cellulose, etc., starch derivatives, any of synthetic hydrophilic polymers of homopolymers or copolymers such as polyvinyl alcohol, polyvinyl imidazole, polyacrylamide, etc.

As the support of the light-sensitive silver halide color photographic material to be used in the present invention, for example, baryta paper, polyethylene-coated paper, polypropylene synthetic paper, transparent support having a reflection layer provided in combination or using a reflective material in combination, for example, glass plate, cellulose acetate, or polyester film such as polyethylene terephthatlate, polyamide film, polycarbonate film, polystyrene film, etc., and also other conventional transparent supports may be available.

These supports can be selected suitably depending on the intended purpose of use of the light-sensitive material.

The present invention is described in more detail by referring to Examples, by which the present invention is not limited at all.

EXAMPLE 1

In all the Examples, the amounts added in the light-sensitive silver halide photographic material indicate grams per 1 $m^2$, unless otherwise particularly noted. Also, the silver halide and colloidal silver were shown as calculated on silver.

On a triacetylcellulose film support, the respective layers with the compositions shown below were formed successively from the support side to prepare a sample 1 of a multicolor photographic element.

| | |
|---|---|
| **Layer 1: Halation preventive layer** | |
| Black colloidal silver | 0.22 |
| UV-ray absorber (UV-1) | 0.20 |
| Colored coupler (CC-1) | 0.05 |
| Colored coupler (CM-2) | 0.06 |
| High boiling point solvent (Oil-1) | 0.20 |
| Gelatin | 1.6 |
| **Layer 2: Intermediate layer** | |
| UV-ray absorber (UV-1) | 0.01 |
| High boiling point solvent (Oil-1) | 0.01 |
| Gelatin | 1.4 |
| **Layer 3: Low sensitivity red-sensitive emulsion layer** | |
| Silver iodobromide emulsion (Em-1) | 0.10 |
| Silver iodobromide emulsion (Em-2) | 0.7 |
| Sensitizing dye (S-1) | $2.2\times10^{-4}$ (mole/1 mole of silver) |
| Sensitizing dye (S-2) | $2.5\times10^{-4}$ (mole/1 mole of silver) |
| Sensitizing dye (S-3) | $0.5\times10^{-4}$ (mole/1 mole of silver) |
| Cyan coupler (C'-4) | 1.3 |
| Cyan coupler (C'-2) | 0.15 |
| Colored cyan coupler (CC-1) | 0.05 |
| DIR compound (D-1) | 0.002 |
| High boiling point solvent (Oil-1) | 0.5 |
| Gelatin | 1.4 |
| **Layer 4: High sensitivity red-sensitive emulsion layer** | |
| Silver iodobromide emulsion (Em-3) | 2.2 |
| Sensitizing dye (S-1) | $2.2\times10^{-4}$ (mole/1 mole of silver) |
| Sensitizing dye (S-2) | $2.0\times10^{-4}$ (mole/1 mole of silver) |
| Sensitizing dye (S-3) | $0.1\times10^{-4}$ (mole/1 mole of silver) |
| Cyan coupler (C'-1) | 0.16 |
| Cyan coupler (C'-2) | 0.018 |
| Cyan coupler (C'-3) | 1.15 |
| Colored cyan coupler (CC-1) | 0.015 |
| DIR compound (D-2) | 0.06 |
| High boiling point solvent (Oil-1) | 0.5 |
| Gelatin | 1.4 |
| **Layer 5: Intermediate layer** | |
| Gelatin | 0.5 |
| **Layer 6: Low sensitivity green-sensitive emulsion layer** | |
| Silver iodobromide emulsion (Em-1) | 1.2 |
| Sensitizing dye (S-4) | $5\times10^{-4}$ (mole/1 mole of silver) |
| Sensitizing dye (S-5) | $2\times10^{-4}$ (mole/1 mole of silver) |
| Magenta coupler (M'-1) | 0.6 |
| Colored magenta coupler (CM-1) | 0.05 |
| DIR compound (D-3) | 0.015 |
| DIR compound (D-4) | 0.020 |

-continued

| | |
|---|---|
| High boiling point solvent (Oil-2) | 0.5 |
| Gelatin | 1.1 |
| Layer 7: Intermediate layer | |
| Gelatin | 0.8 |
| High boiling point solvent (Oil-1) | 0.2 |
| Layer 8: High sensitivity green-sensitive emulsion layer | |
| Silver iodobromide emulsion (Em-3) | 1.5 |
| Sensitizing dye (S-6) | $1.5 \times 10^{-4}$ (mole/1 mole of silver) |
| Sensitizing dye (S-7) | $2.5 \times 10^{-4}$ (mole/1 mole of silver) |
| Sensitizing dye (S-8) | $0.7 \times 10^{-4}$ (mole/1 mole of silver) |
| Magenta coupler (M'-2) | 0.09 |
| Magenta coupler (M'-3) | 0.18 |
| Colored magenta coupler (CM-2) | 0.05 |
| DIR compound (D-3) | 0.015 |
| High boiling point solvent (Oil-3) | 0.5 |
| Gelatin | 1.1 |
| Layer 9: Yellow filter layer | |
| Yellow colloidal silver | 0.12 |
| Color staining preventive (SC-1) | 0.1 |
| High boiling point solvent (Oil-3) | 0.1 |
| Gelatin | 0.8 |
| Layer 10: Low sensitivity blue-sensitive emulsion layer | |
| Silver iodobromide emulsion (Em-1) | 0.28 |
| Silver iodobromide emulsion (Em-2) | 0.28 |
| Sensitizing dye (S-10) | $7 \times 10^{-4}$ (mole/1 mole of silver) |
| Yellow coupler (Y-1) | 0.7 |
| Yellow coupler (Y-2) | 0.13 |
| DIR compound (D-2) | 0.02 |
| High boiling point solvent (Oil-3) | 0.15 |
| Gelatin | 1.0 |
| Layer 11: High sensitivity blue-sensitive emulsion layer | |
| Silver iodobromide emulsion (Em-4) | 0.55 |
| Silver iodobromide emulsion (Em-1) | 0.25 |
| Sensitizing dye (S-9) | $1.3 \times 10^{-4}$ (mole/1 mole of silver) |
| Sensitizing dye (S-10) | $3 \times 10^{-4}$ (mole/1 mole of silver) |
| Yellow coupler (Y-1) | 0.40 |
| Yellow coupler (Y-2) | 0.09 |
| High boiling solvent (Oil-3) | 0.07 |
| Gelatin | 1.1 |
| Layer 12: First protective layer | |
| Fine particulate silver iodobromide emulsion (average grain size 0.08 μm, AgI 2.5 mole %) | 0.43 |
| UV-ray absorber (UV-1) | 0.10 |
| UV-ray absorber (UV-2) | 0.05 |
| High boiling point solvent (Oil-1) | 0.1 |
| High boiling point solvent (Oil-4) | 0.1 |
| Formalin scavenger (HS-1) | 0.5 |
| Formalin scavenger (HS-2) | 0.2 |
| Gelatin | 1.0 |
| Layer 13: Second protective layer | |
| Surfactant (Su-1) | 0.005 |
| Alkali-soluble matting agent (average grain size 2 μm) | 0.10 |
| Cyan dye (AIC-1) | 0.005 |
| Magenta dye (AIM-1) | 0.01 |
| Slipping agent (WAX-1) | 0.04 |
| Gelatin | 0.6 |

In each layer, in addition to the above compositions, the coating aid Su-2, the dispersing aid Su-3, the film hardeners H-1 and H-2, the antiseptic DI-1, the stabilizer Stab-1, the antifoggants AF-1 and AF-2 were added.

Em-1: average grain size 0.46 μm, average silver iodide content 7.7 mole %, mono-dispersed surface low silver iodide content type emulsion Em-2: average grain size 0.32 μm, average silver iodide content 2.2 mole %, mono-dispersed uniform composition emulsion Em-3: average grain size 0.78 μm, average silver iodide content 6.2 mole %, mono-dispersed surface low silver iodide content type emulsion Em-4: average grain size 0.95 μm, average silver iodide content 8.0 mole %, mono-dispersed surface low silver iodide content type emulsion Em-1, Em-3 and Em-4 have multi-layer structures prepared by referring to Japanese Unexamined Patent Publications Nos. 138538/1985 and 245151/1986, which are silver iodobromide comprising primarily octahedrons.

Also, Em-1 to Em-4 all have an average value of grain size/grain thickness of 1.0, with the breadths of the distribution of the grains being respectively 14%, 10%, 12% and 12%.

S-1

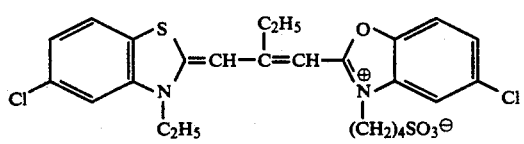

S-2

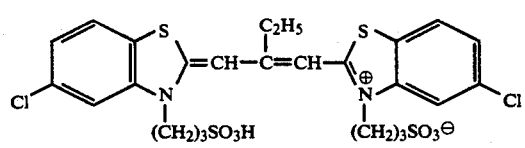

S-3

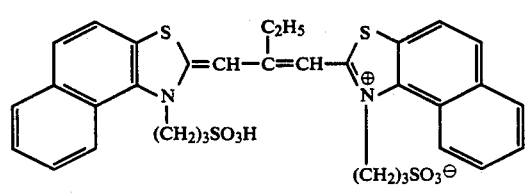

-continued
S-4
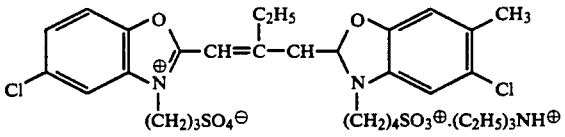
S-5
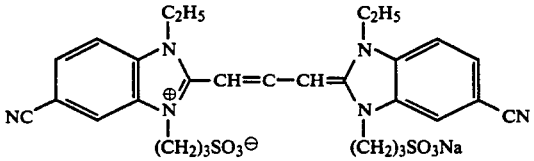
S-6
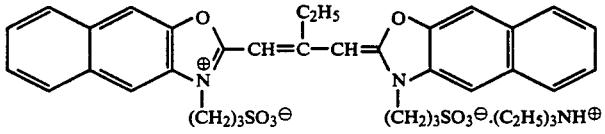
S-7
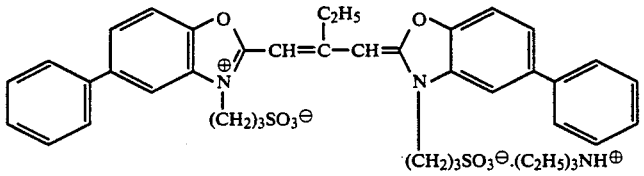
S-8
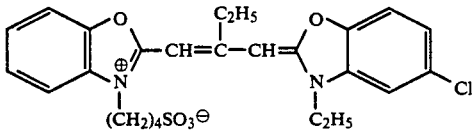
S-9
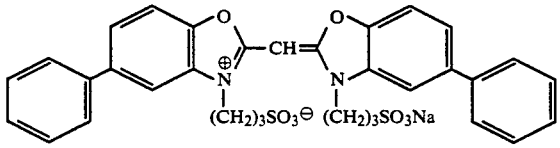
S-10
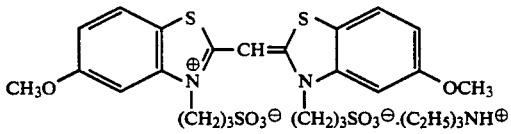
C'-1
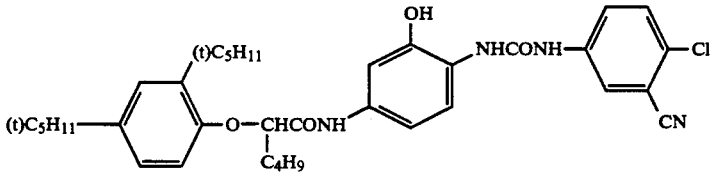
C'-2
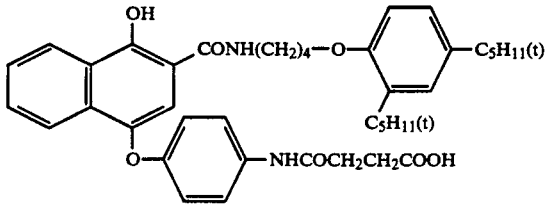

-continued
C'-3
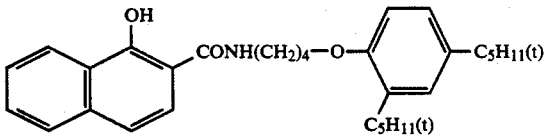
C'-4
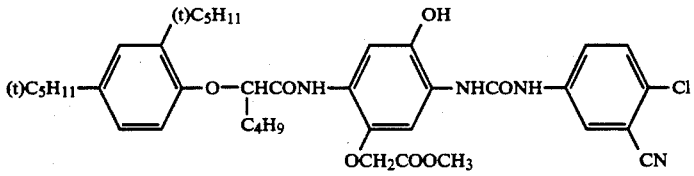
M'-1
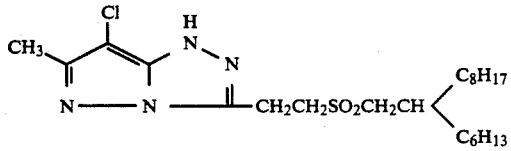
M'-2
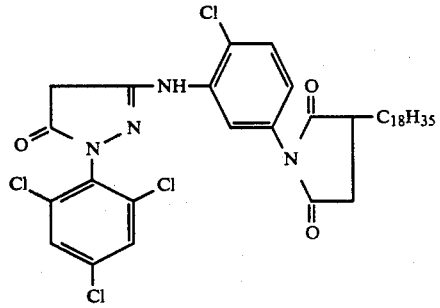
M'-3
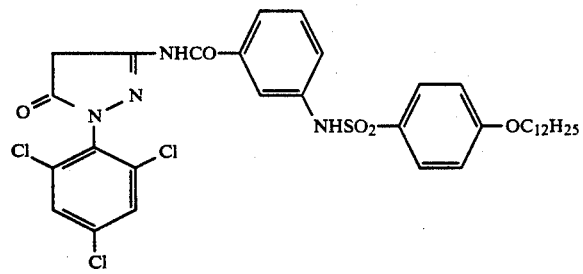
Y-1
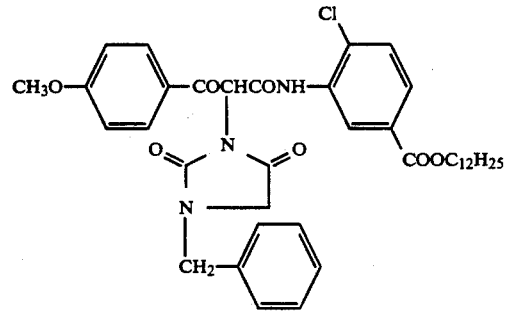

-continued
Y-2
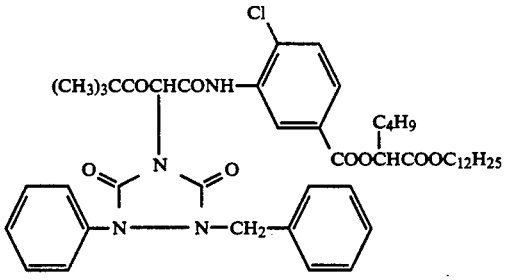
CC-1
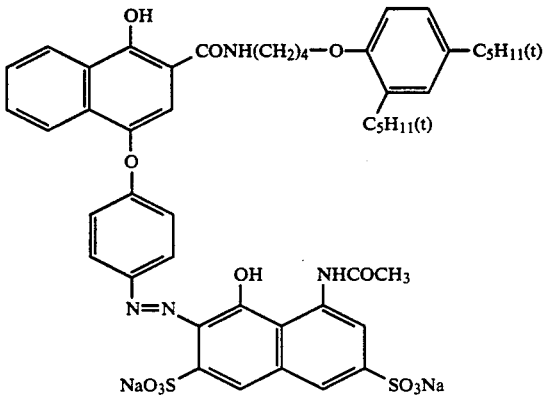
CM-1
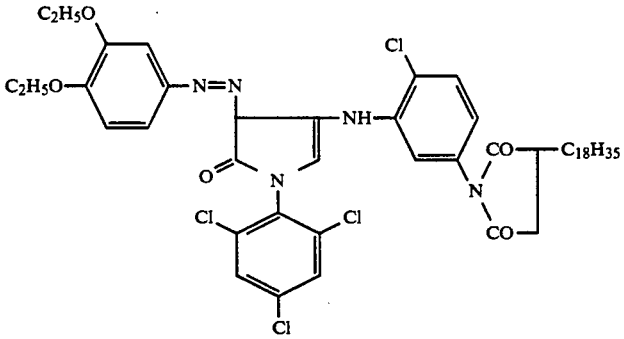
CM-2
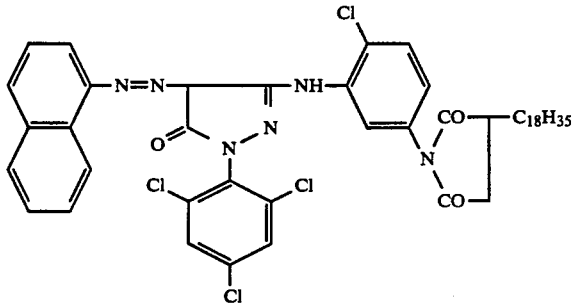

-continued
D-1
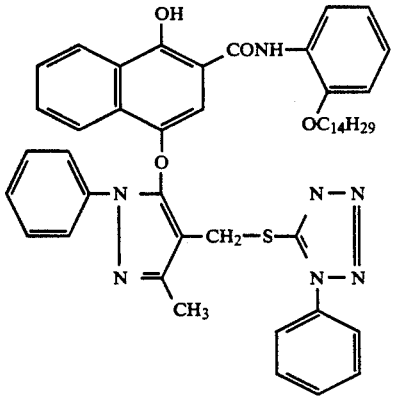
D-2
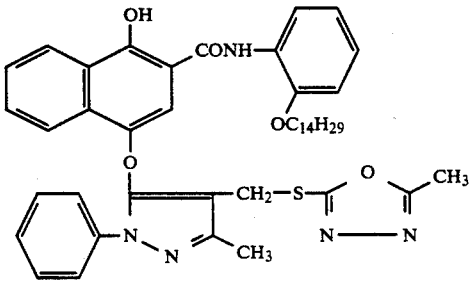
D-3
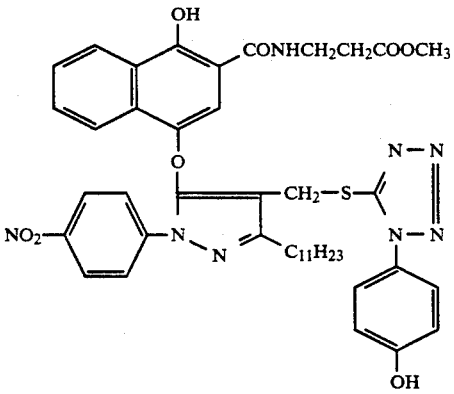
D-4
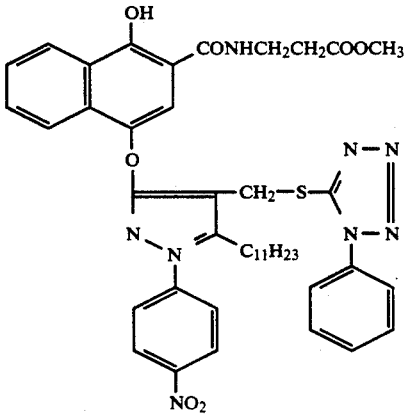

-continued
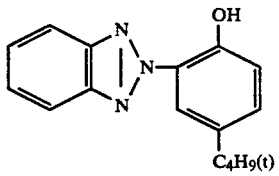
UV-1
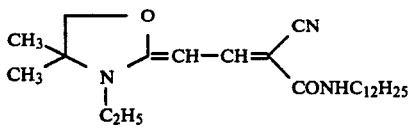
UV-2
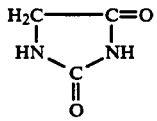
HS-1
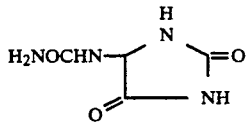
HS-2
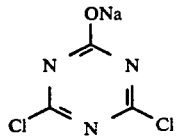
H-1
$[(CH_2{=}CHSO_2CH_2)_3CCH_2SO_2(CH_2)_2]_2N(CH_2)_2SO_3K$
H-2
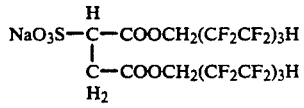
Su-1
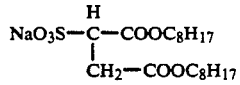
Su-2
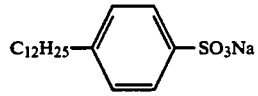
Su-3
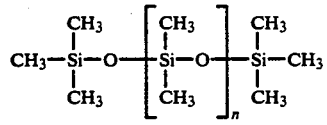
WAX-1
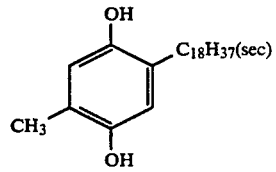
Sc-1

-continued
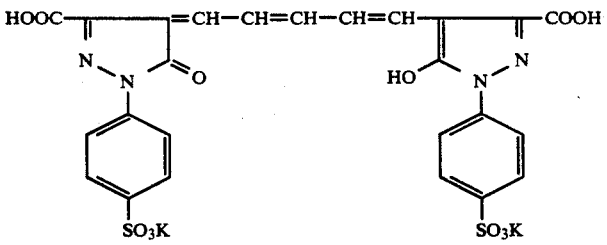
AIC-1
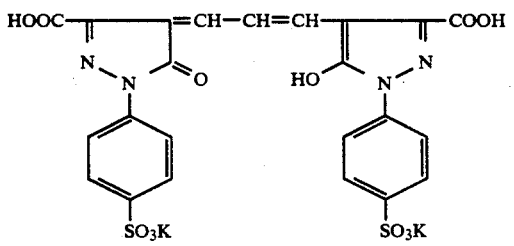
AIM-1
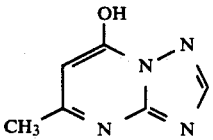
Stab-1
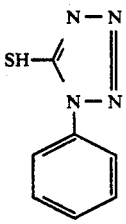
AF-1
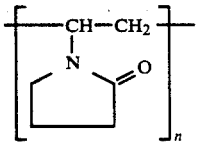
AF-2
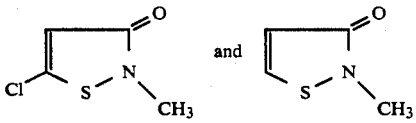
DI-1
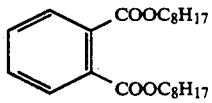
Oil-1
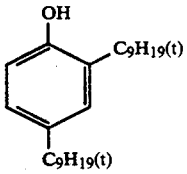
Oil-3
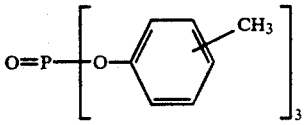

-continued

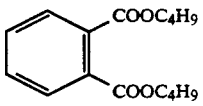

Oil-4

The samples thus prepared were subjected to wedge exposure by use of white light, followed by the developing processing described below.

[Processing for experiment]

| Processing step | Processing time | Processing temp. |
|---|---|---|
| Color developing (1 tank) | 3 min. 15 sec. | 38° C. |
| Bleaching (1 tank) | 45 sec. | 38° C. |
| Fixing (1 tank) | 1 min. 30 sec. | 38° C. |
| Stabilizing (3 tanks cascade) | 1 min. | 38° C. |
| Drying (40° C.-80° C.) | 1 min. | |

The composition of the color developing solution is as follows.

| | |
|---|---|
| Potassium carbonate | 30 g |
| Sodium hydrogen carbonate | 2.5 g |
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-Amino-3-methyl-N-ethyl-N-(β-hydroxylethyl)aniline sulfate | 4.5 g |
| Diethylenetriaminepentaacetic acid | 3.0 g |
| Potassium hydroxide | 1.2 g |

(made up to one liter with addition of water, and adjusted to pH 10.06 with the use of 20% sulfuric acid)

The compositions of the bleaching solution used is as follows.

| Ammonium salt of organic acid ferric complex (shown in Table 1) | |
|---|---|
| Disodium ethylenediaminetetraacetate | 10 g |
| Ammonium bromide | 150 g |
| Glacial acetic acid | 50 ml |
| The above color developer | 200 ml |

(made up to one liter with addition of water, and adjusted to pH suitable as in Table 1)

The composition of the fixing solution used is as follows.

| | |
|---|---|
| Ammonium thiosulfate | 300 g |
| Anhydrous sodium bisulfite | 12 g |
| Sodium metabisulfite | 2.5 g |
| Disodium ethylenediaminetetraacetate | 0.5 g |
| The above bleaching solution | 100 ml |

(made up to one liter with addition of water, and adjusted to pH 6.5 with the use of acetic acid and ammonia water)

The composition of the stabilizing solution is as follows.

| | |
|---|---|
| Formaldehyde (37% solution) | 0.5 ml |
| 5-Chloro-2-methyl-4-isothizolin-3-one | 0.05 g |
| Emulgen 810 | 1 ml |
| Sodium formaldehdye bisulfite adduct | 2 g |

(made up to one liter with addition of water and, adjusted to pH 7 with the use of ammonia water and 50% sulfuric acid)

As shown in Table 1 below, after adjustment by varying the organic acid ferric complex in the bleaching solution, its amount added and pH, developing processing was conducted at 38° C., and the magenta transmission density (green light density) at the unexpected portion of the film sample after processing was measured, and at the same time the residual silver amount at the exposed portion was measured by the fluorescent X-ray method.

The above results are summarized in Table 1.

TABLE 1

| Experiment No. | Organic acid ferric complex | Amount added (mole/liter) | pH | Magenta density at unexposed portion | Residual silver amount at exposed portion (mg/100 cm$^2$) | Remarks |
|---|---|---|---|---|---|---|
| 1-1 | EDTA.Fe | 0.30 | 4.5 | 0.58 | 8.0 | Comparison |
| 1-2 | NTA.Fe | 0.30 | 4.5 | 0.58 | 9.1 | " |
| 1-3 | CyDTA.Fe | 0.30 | 4.5 | 0.57 | 8.7 | " |
| 1-4 | EDTMP.Fe | 0.30 | 4.5 | 0.57 | 8.1 | " |
| 1-5 | NTMP.Fe | 0.30 | 4.5 | 0.57 | 8.7 | " |
| 1-6 | (A-1).Fe | 0.30 | 4.5 | 0.58 | 0.1 | Invention |
| 1-7 | (A-4).Fe | 0.30 | 4.5 | 0.58 | 0.3 | " |
| 1-8 | (B-1).Fe | 0.30 | 4.5 | 0.59 | 0.3 | " |
| 1-9 | (A-9).Fe | 0.30 | 4.5 | 0.57 | 0.1 | " |
| 1-10 | (A-1).Fe | 0.30 | 1.5 | 0.57 | 1.8 | Comparison |
| 1-11 | (A-1).Fe | 0.30 | 2.0 | 0.57 | 0.4 | Invention |
| 1-12 | (A-1).Fe | 0.30 | 3.0 | 0.57 | 0.2 | " |
| 1-13 | (A-1).Fe | 0.30 | 4.0 | 0.57 | 0.1 | " |
| 1-14 | (A-1).Fe | 0.30 | 5.0 | 0.58 | 0.2 | " |
| 1-15 | (A-1).Fe | 0.30 | 5.5 | 0.58 | 0.5 | " |
| 1-16 | (A-1).Fe | 0.30 | 6.0 | 0.62 | 1.5 | Comparison |
| 1-17 | (A-1).Fe | 0.30 | 7.0 | 0.73 | 4.0 | " |

In the Table, EDTA.Fe means ferric ammonium ethylenediaminetetraacetate, NTA.Fe ferric ammonium nitrilotriacetate, CyDTA.Fe ferric ammonium 1,2-cyclohexanediaminetetraacetate, EDTMP.Fe ferric ammonium ethylenediaminetetramethylenephosphonate, NTMP.Fe ferric ammonium nitrilotrimethylenephosphonate, (A-1).Fe ferric ammonium salt of (A-1), (A-4).Fe, (A-7).Fe and (A-9).Fe similarly ferric ammonium salts of (A-4), (A-7) and (A-9), respectively.

As is apparent from the above Table 1, it can be understood that when the organic acid ferric complex in the bleaching solution is the ferric complex of the compound represented by the above formula [A] or [B] of the present invention, and pH is 2.0 to 5.5, the magenta fog density at the unexposed portion is also low, and the residual silver amount is also minute to give both good performances. Whereas, when either one of the above two items comes out of the specified conditions, either of the performances becomes inferior, thus failing to be provided for practical application.

EXAMPLE 2

By use of the color negative film prepared in Example 1, with the concentration of ammonium thiosulfate in the composition of the fixing solution being made as shown in Table 2 below, running processing was performed by use of the replenishing solution shown below, following otherwise the same procedures as in the experiments No. 1 to 6 in Example 1. The ammonium thiosulfate concentration in the fixing replenishing solution was made the same as that in the fixing solution used in the respective experiments.

The composition of the color developing replenishing solution used is as follows.

| | |
|---|---|
| Potassium carbonate | 35 g |
| Sodium hydrogen carbonate | 3 g |
| Potassium sulfite | 5 g |
| Sodium bromide | 0.4 g |
| Hydroxylamine sulfate | 3.1 g |
| 4-Amino-3-methyl-N-ethyl-N-(β-hydroxyethyl)aniline sulfate | 5.8 g |
| Potassium hydroxide | 2 g |

(made up to one liter with addition of water, and adjusted to pH 10.12 with addition of potassium hydroxide or 20% sulfuric acid)

The composition of the bleaching replenishing solution used is as follows.

| | |
|---|---|
| Organic acid ferric complex | 0.32 mole |
| Disodium ethylenediaminetetraacetate | 2 g |
| Ammonium bromide | 178 g |
| Glacial acetic acid | 1.0 mole |

(made up to one liter with addition of water, and adjusted to pH 3.5 with ammonia water or glacial acetic acid)

The composition of the fixing replenishing solution used is as follows.

| | |
|---|---|
| Ammonium thiosulfate | shown in Table 2 |
| Anhydrous sodium bisulfite | 15 g |
| Sodium metabisulfite | 3 g |
| Disodium ethylenediaminetetraacetate | 0.8 g |

(made up to one liter with addition of water, and pH adjusted to 6.5)

For the stabilizing replenishing solution, the stabilizing solution of Example 1 was employed.

The processing steps, the processing time, the processing temperature and the replenished amount in the running processing were made as follows.

| Processing step | Processing time | Processing temperature | Replenished amount |
|---|---|---|---|
| Color developing | 3 min. 15 sec. | 38° C. | 760 ml |
| Bleaching | 45 sec. | 38° C. | 150 ml |
| Fixing | 1 min. 30 sec. | 38° C. | 860 ml |
| Stabilizing | 60 sec. | 38° C. | 860 ml |
| Drying | 1 min. | 40–70° C. | — |

(replenished amount is value per 1 $m^2$ of the light-sensitive material)

Running processing is performed until the fixing replenishing solution was replenished in an amount of 3-fold volume of the fixing tank. However, processing was performed so that the running processing amount of one day became 0.1 of the liquid amount relative to the tank volume (called 0.1 R). As evaluation of the magenta density at the unexposed portion, the residual silver amount at the maximum density portion and fixability, the residual silver amount at the unexposed portion was measured. However, the residual silver amount at the maximum density portion and the magenta density at the unexposed aportion are the density and the residual silver amount after complete fixing.

The results are summarized in Table 2.

TABLE 2

| Experiment No. | Organic acid ferric complex | Fixing agent ammonium thiosulfate concentration (mole/liter) | Magenta density at unexposed portion | Residual silver amount at maximum density portion | Residual silver amount at minimum density portion | | |
|---|---|---|---|---|---|---|---|
| | | | | | Top | 1.5R | 3.0R |
| 2-1 | EDTA.Fe | 2.0 | 0.57 | 9.2 | 0.1 | 0.1 | 0.2 |
| 2-2 | EDTA.Fe | 0.5 | 0.57 | 9.2 | 0.2 | 0.3 | 0.4 |
| 2-3 | EDTA.Fe | 0.8 | 0.57 | 9.2 | 0.2 | 0.2 | 0.3 |
| 2-4 | EDTA.Fe | 1.0 | 0.57 | 9.2 | 0.1 | 0.1 | 0.2 |
| 2-5 | EDTA.Fe | 3.0 | 0.57 | 9.2 | 0.1 | 0.1 | 0.1 |
| 2-6 | CyDTA.Fe | 2.0 | 0.57 | 9.8 | 0.1 | 0.1 | 0.2 |
| 2-7 | NTA.Fe | 2.0 | 0.56 | 9.5 | 0.1 | 0.1 | 0.2 |
| 2-8 | EDTMP.Fe | 2.0 | 0.57 | 9.5 | 0.1 | 0.1 | 0.2 |
| 2-9 | NTMP.Fe | 2.0 | 0.57 | 9.7 | 0.1 | 0.1 | 0.2 |
| 2-10 | (A-1).Fe | 2.0 | 0.57 | 0.2 | 0.1 | 0.1 | 0.2 |
| 2-11 | (A-1).Fe | 0.5 | 0.57 | 0.2 | 0.2 | 1.0 | 2.4 |
| 2-12 | (A-1).Fe | 0.8 | 0.57 | 0.2 | 0.2 | 0.6 | 1.3 |
| 2-13 | (A-1).Fe | 1.0 | 0.57 | 0.2 | 0.1 | 0.2 | 0.4 |
| 2-14 | (A-1).Fe | 3.0 | 0.57 | 0.2 | 0.1 | 0.1 | 0.2 |
| 2-15 | (A-1).Fe | 5.0 | 0.57 | 0.2 | 0.1 | 0.3 | 0.8 |

The abbreviations of the organic acid ferric salts in the above Table are the same a in Table 1 in Example 1.

From the above Table 2, it can be understood that when a bleaching solution is used in which the organic acid ferric complex of the present invention is used as the bleaching agent and the pH is made within the range of the present invention, the bleaching processing step is extremely rapid as 45 seconds (ordinarily 4 minutes 20 seconds to 6 minutes 30 seconds), and in spite of low amount of replenishment, generation of fog at the unexposed portion which is bleaching fog is little and there exist substantially no residual silver at the density portion.

Also, it can be understood that when the organic acid ferric complex of the present invention is used as the bleaching agent in the bleaching solution without adjusting the concentration of the fixing agent within the scope of the present invention, the fixability is liable to be deteriorated by running, while stable fixability can be obtained with deterioration of fixability by running being improved by making the fixing agent concentration that of the present invention.

EXAMPLE 3

Experiments and evaluations were conducted in the same manner as in Example 2 except that the kinds of the organic ferric complexes and the amounts of acetic acid in the bleaching solution compositions were made as shown in Table 3. However, the concentration of ammonium thiosulfate in the fixing solution was made 2.0 mole/liter. The results are shown in Table 3. As for desiliverizability, there was slight difference depending on the amount of acetic acid, but no marked difference was observed and hence only the magenta density at the unexposed portion was written in Table 3.

TABLE 3

| Experiment No. | Organic acid ferric complex | Glacial acetic acid amount in bleaching replenishing solution | Magenta density at unexposed portion |
|---|---|---|---|
| 3-1 | (A-1).Fe | 0.2 | 0.64 |
| 3-2 | " | 0.5 | 0.60 |
| 3-3 | " | 1.0 | 0.57 |
| 3-4 | " | 2.0 | 0.55 |
| 3-5 | " | 3.0 | 0.55 |
| 3-6 | (B-1).Fe | 0.2 | 0.66 |
| 3-7 | " | 0.5 | 0.61 |
| 3-8 | " | 1.0 | 0.58 |
| 3-9 | " | 2.0 | 0.57 |
| 3-10 | " | 3.0 | 0.57 |

As is apparent from Table 3, it can be understood that by utilizing glacial acetic acid in the bleaching replenishing solution in an amount of 1.0 mole/liter or more, the magenta density at the unexposed portion (bleaching fog) is lowered.

EXAMPLE 4

Experiments were conducted in the same manner as in Example 2 except that the kinds of the organic acid ferric complexes in the bleaching solution composition and the concentrations of ammonium thiosulfate in the fixing solution composition were made as shown in Table 4 below, and the residual silver amounts at the minimum density portion were measured. The results are shown in Table 4.

TABLE 4

| Experiment No. | Organic acid ferric complex salt | Fixing agent concentration | Fixing processing time | Residual silver amount at minimum density portion (mg/100 cm$^2$) Top | 1.5R | 3.0R |
|---|---|---|---|---|---|---|
| 4-1 | EDTA.Fe | 0.5 | 30 sec. | 0.8 | 0.9 | 1.1 |
| 4-2 | " | " | 60 | 0.4 | 0.5 | 0.7 |
| 4-3 | " | " | 120 | 0.2 | 0.3 | 0.4 |
| 4-4 | " | " | 180 | 0.1 | 0.2 | 0.2 |
| 4-5 | " | 3.0 | 30 | 0.4 | 0.6 | 0.8 |
| 4-6 | " | " | 60 | 0.2 | 0.3 | 0.4 |
| 4-7 | " | " | 120 | 0.1 | 0.1 | 0.2 |
| 4-8 | " | " | 180 | 0.1 | 0.1 | 0.2 |
| 4-9 | (A-1).Fe | 0.5 | 30 | 0.8 | 1.8 | 3.2 |
| 4-10 | " | " | 60 | 0.4 | 1.2 | 2.7 |
| 4-11 | " | " | 120 | 0.2 | 0.9 | 2.1 |
| 4-12 | " | " | 180 | 0.7 | 0.6 | 1.3 |
| 4-13 | " | 2.0 | 30 | 0.4 | 0.6 | 0.9 |
| 4-14 | " | " | 60 | 0.2 | 0.3 | 0.5 |
| 4-15 | " | " | 120 | 0.1 | 0.1 | 0.2 |
| 4-16 | " | " | 180 | 0.1 | 0.1 | 0.2 |

As is apparent from Table 4, EDTA.Fe which has been used in the prior art will not be greatly deteriorated in the minimum density by running, but fixability is deteriorated to great extent with running by use of (A-1).Fe.

Also, it can be understood that this tendency will appear markedly as the fixing processing time is shorter. Further, it can be also understood the deterioration in fixability by running is small even when (A-1).Fe is used, by use of the fixing agent concentration of the present invention.

EXAMPLE 5

Into the fixing solutions and the fixing replenishing solutions used in Example 2, Experiments No. 2-10, 15 g/liter of the compounds shown in Table 5 below were added, and the same experiments as in Experiments No. 2-10 were conducted.

The results are summarized in Table 5.

TABLE 5

| Experiment No. | Additive | Magenta density at unexposed portion | Residual silver amount at minimum density portion (mg/100 cm$^2$) 3.0R |
|---|---|---|---|
| 5-1 | FA-1 | 0.56 | 0.1 |
| 5-2 | FA-12 | 0.56 | 0 |
| 5-3 | FA-22 | 0.56 | 0.1 |
| 5-4 | FA-32 | 0.56 | 0.1 |
| 5-5 | FA-38 | 0.56 | 0.1 |
| 5-6 | FA-35 | 0.56 | 0.1 |
| 5-7 | FB-1 | 0.56 | 0 |
| 5-8 | FB-4 | 0.55 | 0 |
| 5-9 | FB-1 + FB-4 (FB-1/FB-4 = 2/1) | 0.55 | 0 |
| 5-10 | FB-1 + FA-12 (FB-1/FA-12 = 2/1) | 0.55 | 0 |

From the above Table 5, it can be understood that the objective effect of the present invention is further promoted when using the compound represented by the above formula [FA] in combination with compounds or compounds of compound group [FB] in the processing method of the present invention.

EXAMPLE 6

In the bleaching processing tank and the fixing processing tank in Example 2, Experiments No. 2–10 was provided a nozzle made of polyvinyl chloride perforated to a diameter of 0.5 mm, and experiments were conducted while blowing a processing solution by use of Iwaki magnet pump MD-15 onto the light-sensitive material emulsion surface (the bleaching processing tank is applied with aeration), following otherwise the same procedures. As the result, the magenta density at the unexposed portion became 0.55, and the residual silver amount at the unexposed portion after running processing (3.0R) reduced to 0.

EXAMPLE 7

100 g/liter of the fixing solution and the fixing replenishing solution EDTA.Fe used in Example 2, Experiments No. 2–10 were added, and pH was adjusted each to 7.0 to carry out similar experiments, whereby substantially the same results were obtained.

EXAMPLE 8

To the fixing solutions and the fixing replenishing solutions used in Example 2, Experiments No. 2–10 were added each 10 g/liter of the above exemplary compounds (AO-9), sulfite adduct of (AO-14), (AO-1), (AO-6), (AO-2) to carry out similar experiments. The fixing tank solution after completion of the running processing was stored at 38 C for 4 weeks. The appearance of the processing solution after storage was observed, followed by developing processing. As the result, no change was observed in those wherein the above exemplary compounds (AO-9), sulfite adduct of (AO-14), (AO-1), (AO-6), (AO-2) were added, but precipitation of sulfur was observed on the fixing solution surface in the case of no addition. Also, the magenta density at the unexposed portion was higher in the case of no addition by 0.01 as compared with those when added.

EXAMPLE 9

In place of the cyan couplers C'-2, C'-3 used in Example 1, the same moles of cyan couplers 20, 22, 30, 33 described on pages 252, 274 in Japanese Unexamined Patent Publication No. 32501/1988 as shown below were used, and the same evaluations as in Example 2 were conducted:

(20)

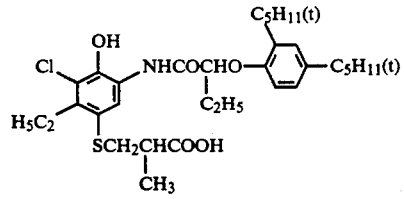

(22)

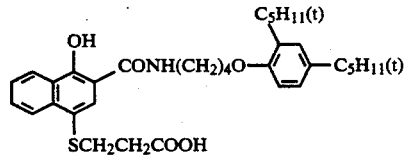

(30)

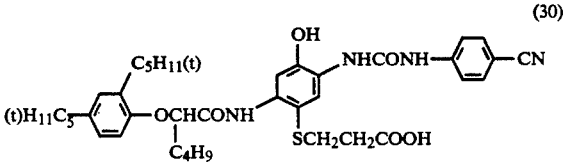

(33)

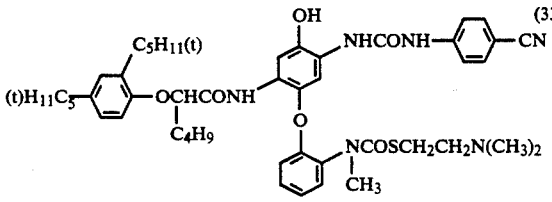

As the result, the cyan density at the unexposed portion was lowered by 0.02 to 0.04. Also, as for desilverizability, it was improved by about 10%.

EXAMPLE 10

A sample of a multi-color photographic element was prepared in the same manner as in Example 1 except that in place of the sensitizing dyes S-1 in the color photographic material of Example 1, the same mole of sensitizing dyes S-11 and S-12 (1:1 mole ratio) were used; in place of the cyan couplers C'-2 and C'-3, the same mole of C'-5 and C'-6 were used, respectively; and in place of the magenta couplers M'-1, M'-2, M'-3, the same mole of M'-4, M'-5 and M'-6 were used.

The thus prepared element was subjected to the same evaluation as in Example 2, and as a result, further improvement in magenta stain (about 0.02) has been found.

(S-11)

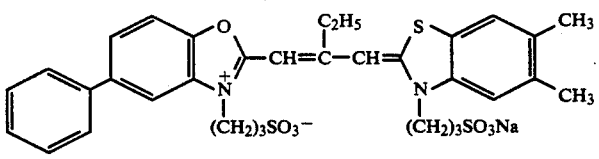

(S-12)

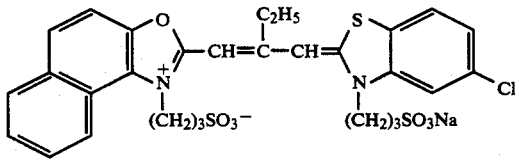

-continued
(S-13)
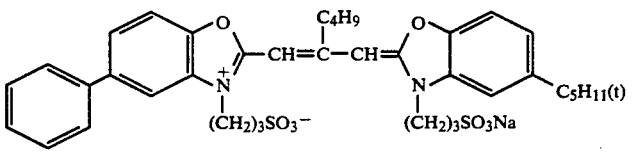
(S-14)
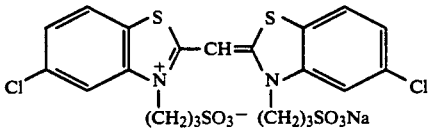
(C'-5)
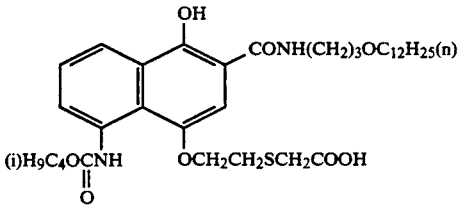
(C'-6)
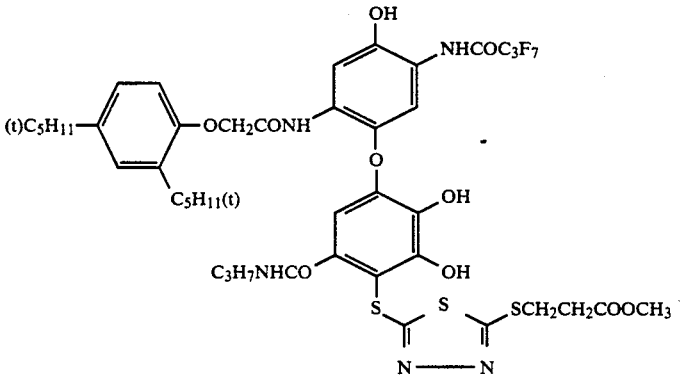
(M'-4)
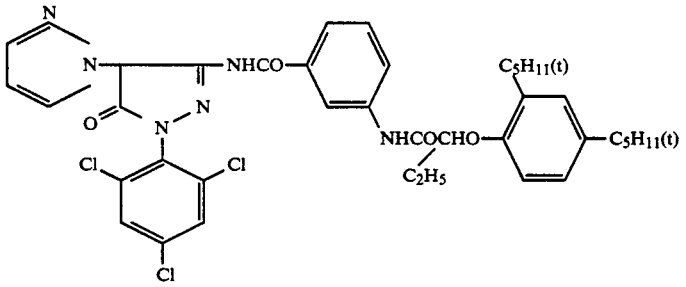
(M'-5)
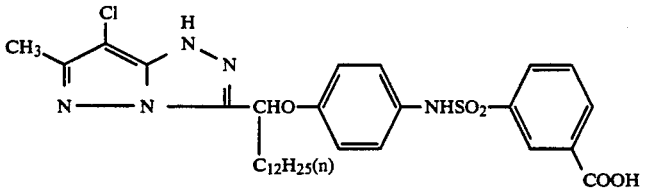
(M'-6)
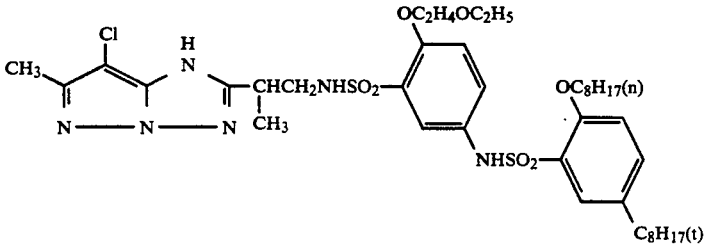

EXAMPLE 11

A sample of a multi-color photographic element was prepared in the same manner as in Example 10 except that magenta couplers M-18, M-21, M-37, M-44, M-61 and M-63 described on pages 208 to 227 of Japanese Patent Application No. 32501/1988 were used in place of the magenta couplers M'-4 in Example 10, and the same evaluation was conducted as in Example 10, and as a result, the magenta fog is found to be lowered further by 0.01 to 0.02.

the grain was cubic, and the breadth of the distribution were 12%, 10%, 10% and 12%, respectively.

The above silver chlorobromide emulsions were prepared according to Japanese Unexamined Patent Publication No. 6941/1989 and the thus prepared samples were subjected to the same evaluation as in Example 1. As a result, substantially the same tendencies are shown, however, bleaching fog is higher by 0.03 to 0.05 when silver chlorobromide emulsion was used as compared with those when silver iodobromide in Example 1 was used.

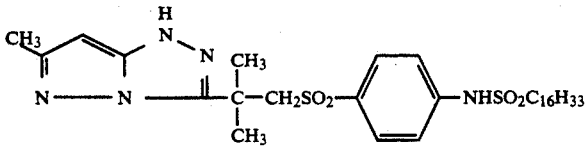

(M-18)

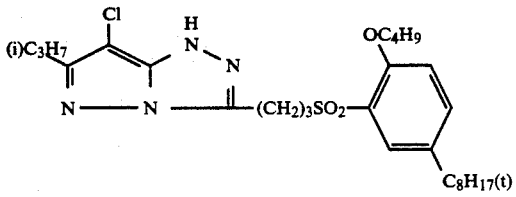

(M-21)

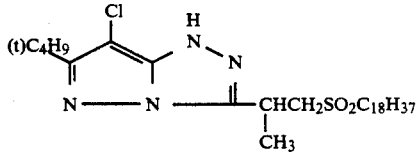

(M-37)

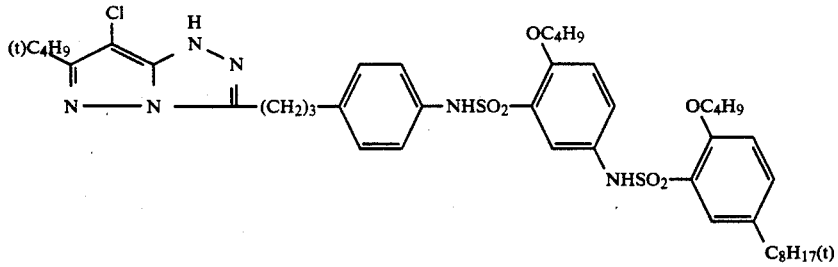

(M-44)

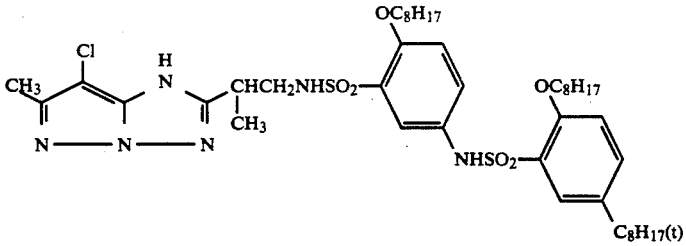

(M-61)

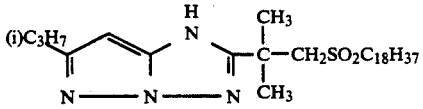

(M-63)

EXAMPLE 12

By using four kinds of silver chlorobromide emulsions containing 98% of silver chloride in place of the silver iodobromide emulsion Ems 1 to 4 in the sample 1 of Example 1, four samples were prepared. Here, grain size of the silver chlorobromide emulsions described above correspond to those of Ems 1 to 4, the shape of According to the present invention, there is provided a bleaching or fixing processing method of a light-sensitive silver halide color photographic material, which is rapid, improved in bleaching fog and fixability, and also excellent in processing stability even in the case of continuous processing and small amount processing.

We claim:

1. A method for processing a light-sensitive silver halide color photographic material by subjecting a light-sensitive silver halide color photographic material after imagewise exposure to color developing processing, then immediately to bleaching processing with a bleaching solution, followed by processing with a processing solution having fixing ability, wherein said bleaching solutions contains at least 0.1 mole/liter of at least one of ferric complexes of the compounds represented by the formula (A) or (B) shown below and has a pH of 2.0 to 5.5, and said processing solution having fixing ability contains at least one mole/liter of a thiosulfate and 0.1 to 200 g/liter of a compound selected from the group (FB) shown below and 0.1 to 80 g/liter of a compound of the formula (A-I) or (A-II) shown below:

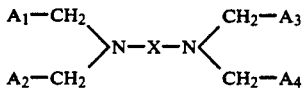

Formula (A)

wherein $A_1$ to $A_4$ may be either the same or different, and each represent $—CH_2OH$, —COOM or $—PO_3M_1M_2$; M, $M_1$ and $M_2$ each represent hydrogen atom, sodium atom, potassium atom or ammonium group; X represents a substituted or unsubstituted alkylene group having 3 to 6 carbon atoms,

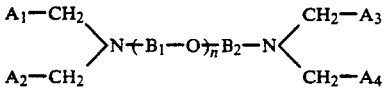

Formula (B)

wherein $A_1$ to $A_4$ may be either the same or different and each represent $—CH_2OH$, —COOM or $—PO_3M_1M_2$; M, $M_1$ and $M_2$ each represent hydrogen atom, sodium atom, potassium atom or ammonium group; n represents an integer of 1 to 8; $B_1$ and $B_2$ each represent a substituted or unsubstituted alkylene group having 2 to 5 carbon atoms, which may be either the same or different, (FB) is thiourea,
ammonium iodide,
potassium iodide,
ammonium thiocyanate,
potassium thiocyanate,
sodium thiocyanate or
thiocyanocatechol,

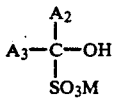

Formula [A-I]

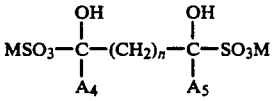

Formula [A-II]

$A_2$, $A_3$, $A_4$, $A_5$ each represent hydrogen atom, an alkyl group having 1 to 6 carbon atoms, a formyl group, an acyl group or an alkenyl group.

2. The method according to claim 1, wherein said processing solution having fixing ability contains a thiosulfate in an amount of 1.3 moles/liter or more.

3. The method of claim 1 wherein the compound of group (FB) is thiourea or ammonium thiocyanate.

4. The method of claim 1 wherein the thiocyanate is present in an amount of 1.3 to 3 mole/liter.

5. The method of claim 1, wherein the compound of the formula (A-I) or (A-II) is one of the following:

AO-1 formaldehyde sodium bisulfate
AO-2 acetaldehyde sodium bisulfate
AO-3 propionaldehyde sodium bisulfate
AO-4 butylaldehyde sodium sulfate
AO-5 succinicaldehyde sodium bisulfate
AO-6 glutaraldehyde sodium bisulfate
AO-7 β-methylglutaraldehyde bissodium bisulfate and
AO-8 maleic dialdehyde bissodium bisulfate.

* * * * *